US010605455B2

(12) United States Patent
Matsumoto et al.

(10) Patent No.: US 10,605,455 B2
(45) Date of Patent: Mar. 31, 2020

(54) COMBUSTION BURNER AND BOILER

(71) Applicant: MITSUBISHI HITACHI POWER SYSTEMS, LTD., Kanagawa (JP)

(72) Inventors: Keigo Matsumoto, Tokyo (JP); Atsushi Yuasa, Tokyo (JP); Yukihiro Tominaga, Tokyo (JP); Akimasa Takayama, Tokyo (JP); Kazuhiro Domoto, Kanagawa (JP); Keita Tsukahara, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 193 days.

(21) Appl. No.: 15/549,510

(22) PCT Filed: Mar. 17, 2016

(86) PCT No.: PCT/JP2016/058609
§ 371 (c)(1),
(2) Date: Aug. 8, 2017

(87) PCT Pub. No.: WO2016/158473
PCT Pub. Date: Oct. 6, 2016

(65) Prior Publication Data

US 2018/0031232 A1 Feb. 1, 2018

(30) Foreign Application Priority Data

Mar. 31, 2015 (JP) ..... 2015-073499

(51) Int. Cl.
*F23K 3/02* (2006.01)
*F23D 1/00* (2006.01)
(Continued)

(52) U.S. Cl.
CPC ..... *F23K 3/02* (2013.01); *F23C 99/00* (2013.01); *F23D 1/00* (2013.01); *F23D 1/04* (2013.01);
(Continued)

(58) Field of Classification Search
CPC ..... F23D 2201/10; F23D 2900/11401; F23D 1/00
See application file for complete search history.

(56) References Cited

U.S. PATENT DOCUMENTS 2,380,463 A * 7/1945 Poole ..... F23D 1/00 431/184
4,634,054 A * 1/1987 Grusha ..... F23C 5/06 239/423
(Continued)

FOREIGN PATENT DOCUMENTS

CN 2847059 12/2006
CN 201166362 12/2008
(Continued)

OTHER PUBLICATIONS

Written Opinion of the International Searching Authority dated May 31, 2016 in International Application No. PCT/JP2016/058609, with English-language translation.
(Continued)

*Primary Examiner* — David J Laux
(74) *Attorney, Agent, or Firm* — Wenderoth, Lind & Ponack, L.L.P.

(57) ABSTRACT

In this combustion burner and boiler, interference of ignition in a flame stabilizer is suppressed and flame stabilizing performance is improved by providing: a fuel nozzle which ejects a fuel gas that is a mixture of pulverized coal and air; a combustion air nozzle which ejects a fuel gas combustion air from outside of the fuel nozzle; a secondary air nozzle
(Continued)

which ejects secondary air from the outside of the combustion air nozzle; and a flame stabilizer which comprises a first flame stabilizer main body which is arranged at the leading end of the fuel nozzle and separated by a prescribed space from the inner wall surface of the fuel nozzle and which forms a ring shape having as the center an axial line along the ejection direction of the fuel gas.

9 Claims, 13 Drawing Sheets

(51) Int. Cl.
*F23L 9/00* (2006.01)
*F23C 99/00* (2006.01)
*F23D 1/04* (2006.01)

(52) U.S. Cl.
CPC ..... *F23L 9/00* (2013.01); *F23D 2201/10* (2013.01); *F23D 2208/00* (2013.01); *F23D 2900/11401* (2013.01)

(56) References Cited

U.S. PATENT DOCUMENTS

| | | | | |
|---|---|---|---|---|
| 5,315,939 | A | 5/1994 | Rini et al. | |
| 5,660,045 | A | 8/1997 | Ito et al. | |
| 6,058,855 | A * | 5/2000 | Ake | F23C 3/00 110/165 A |
| 9,671,108 | B2 * | 6/2017 | Matsumoto | F23C 5/32 |
| 2009/0277364 | A1 | 11/2009 | Donais et al. | |
| 2012/0247376 | A1 | 10/2012 | Matsumoto et al. | |
| 2014/0011141 | A1 | 1/2014 | Matsumoto et al. | |
| 2015/0068438 | A1 | 3/2015 | Taniguchi et al. | |
| 2016/0010853 | A1 | 1/2016 | Matsumoto et al. | |
| 2016/0356489 | A1 | 12/2016 | Matsumoto et al. | |
| 2016/0356490 | A1 | 12/2016 | Matsumoto et al. | |
| 2016/0356494 | A1 | 12/2016 | Matsumoto et al. | |
| 2017/0045221 | A1 | 2/2017 | Matsumoto et al. | |

FOREIGN PATENT DOCUMENTS

| | | |
|---|---|---|
| CN | 101965482 | 2/2011 |
| CN | 103443543 | 12/2013 |
| CN | 204141575 | 2/2015 |
| CN | 204187609 | 3/2015 |
| JP | 4-24404 | 1/1992 |
| JP | 08-135919 | 5/1996 |
| JP | 08-219415 | 8/1996 |
| JP | 09-203505 | 8/1997 |
| JP | 2782384 | 5/1998 |
| JP | 10-220707 | 8/1998 |
| JP | 10-318504 | 12/1998 |
| JP | 11-148610 | 6/1999 |
| JP | 11-281010 | 10/1999 |
| JP | 2001-082706 | 3/2001 |
| JP | 2009-204256 | 9/2009 |
| JP | 2010-270992 | 12/2010 |
| JP | 2012-215362 | 11/2012 |
| JP | 5374404 | 9/2013 |
| JP | 2014-173777 | 9/2014 |
| JP | 6049503 | 12/2016 |
| WO | 2011/077762 | 6/2011 |
| WO | 2012/137573 | 10/2012 |

OTHER PUBLICATIONS

Office Action dated Aug. 28, 2018 in corresponding Chinese Application No. 201680014992.0, with English translation.
Notification of Reasons for Refusal dated Dec. 11, 2018 in Japanese Application No. 2015-073499, with English translation.
Office Action dated Dec. 5, 2018 in German Application No. 11 2016 001 569.0, with English translation.

* cited by examiner

COMBUSTION BURNER AND BOILER

TECHNICAL FIELD

The present invention relates to a combustion burner for mixing and combusting fuel and air, and a boiler for generating steam from combustion gas produced by such a combustion burner.

BACKGROUND ART

Conventional coal burning boilers include a furnace that has a hollow shape and that is installed vertically. In such boilers, a plurality of combustion burners are arranged on the furnace wall along the circumferential direction, in multiple steps in the vertical direction. Additionally, in these combustion burners, a fuel-air mixture of pulverized coal (fuel) obtained by crushing coal and primary air is supplied and, also, a high temperature secondary air is supplied. Flames are formed by blowing the fuel-air mixture and the secondary air into the furnace. Thus, combustion in the furnace is possible. Moreover, a flue is connected to an upper portion of the furnace, and a superheater, a reheater, a fuel economizer, and the like for collecting the heat of the exhaust gas are provided on the flue, and heat exchange between the exhaust gas produced by combustion in the furnace and water is carried out. Thus, steam can be generated.

Examples of such a combustion burner of a coal burning boiler include the technology in the Patent Documents described below. The combustion burners described in the Patent Documents include a fuel nozzle capable of blowing a fuel gas obtained by mixing pulverized coal and a primary air, and a secondary air nozzle capable of blowing a secondary air from outside the fuel nozzle. In these combustion burners, a flame stabilizer is provided on an axial center side of the leading end of the fuel nozzle and, as a result, the pulverized coal concentrated flow is made to collide with the flame stabilizer, thereby enabling stable, low NOx combustion in a wide load range.

CITATION LIST

Patent Document

Patent Document 1: Japanese Patent No. 5374404B

Patent Document 2: Japanese Unexamined Patent Application Publication No. 2012-215362A

SUMMARY OF INVENTION

Technical Problems

With the conventional combustion burner described above, the flame stabilizer has a splitter shape and is disposed on the leading end of the fuel nozzle. As such, a recirculation area is formed on the downstream side of the flame stabilizer and combustion of the pulverized coal is maintained. In this case, it is thought that the flame stability of the flame stabilizer can be improved by increasing the size of the flame stabilizer, increasing the number of flame stabilizers, or the like. However, if the size of the flame stabilizer or the number of flame stabilizers is increased, the blockage rate at the leading end of the fuel nozzle will increase and, if ignition occurs in these flame stabilizers, the flow rate in the vicinity of the igniter will increase. Consequently, interference of ignition that obstructs ignition may occur due to the flow rate increasing at proximal flame stabilizers. Additionally, if the size of the flame stabilizer is increased, the flow rate of the fuel gas and the pulverized coal concentration will fluctuate at the leading end of the fuel nozzle and, consequently, flame may not be maintained evenly across the flame stabilizer.

In light of the problems described above, an object of the present invention is to provide a combustion burner and a boiler whereby interference of ignition between flame stabilizers is suppressed and flame stabilizing performance is improved.

Solution to Problem

A combustion burner of the present invention that achieves the object described above includes a fuel nozzle configured to eject fuel gas obtained by mixing fuel and air; a secondary air nozzle configured to eject air from outside the fuel nozzle; and a flame stabilizer including a first flame stabilizer main body disposed on a leading end of the fuel nozzle and separated by a predetermined space from an inner wall surface of the fuel nozzle, and forming a ring shape having an axial line along the ejection direction of the fuel gas as a center.

Accordingly, a recirculation area is formed on the downstream side of the first flame stabilizer main body and, as a result, the fuel gas flowing in the fuel nozzle can maintain the combustion of the fuel. Here, because the first flame stabilizer main body of the flame stabilizer forms a ring shape, the flame stabilizers will not cross each other even if the number of flame stabilizers is increased or the size of the flame stabilizer is increased. As a result, guide surfaces for forming the recirculation area can be sufficiently secured without causing interference of ignition. Additionally, due to the fact that the ignition surface is connected by a single line, it is possible to cause broad ignition throughout the recirculation area downstream from the flame stabilizer by ignition at one portion. Furthermore, fluctuation of the flow rate and the fuel concentration of the fuel gas at the leading end of the fuel nozzle can be suppressed. As a result, interference of ignition between flame stabilizers can be suppressed and flame stabilizing performance can be enhanced.

According to the combustion burner of the present invention, the flame stabilizer includes a second flame stabilizer main body disposed inside the first flame stabilizer main body, the second flame stabilizer main body being separated a predetermined space from the first flame stabilizer main body.

Accordingly, the second flame stabilizer main body is disposed inside the first flame stabilizer main body, separated the predetermined space from the first flame stabilizer main body and, as such, a recirculation area can be formed in the center portion of the fuel nozzle, and internal flame stabilizing performance can be enhanced.

According to the combustion burner of the present invention, the second flame stabilizer main body forms a ring shape having the axial line as a center.

Accordingly, the second flame stabilizer main body that forms a ring shape is disposed inside the first flame stabilizer main body, the second flame stabilizer main body being separated the predetermined space from the first flame stabilizer main body and, as such, the recirculation area can be formed in a wide region in the center portion of the fuel nozzle, and internal flame stabilizing performance can be enhanced.

According to the combustion burner of the present invention, the first flame stabilizer main body forms a rectangular ring shape or a round ring shape.

Accordingly, the shape of the first flame stabilizer main body can be optimized depending on the shape of the fuel nozzle.

According to the combustion burner of the present invention, an outer periphery of the first flame stabilizer main body is supported on the inner wall surface of the fuel nozzle by a plurality of support members.

Accordingly, the first flame stabilizer main body can be appropriately supported by the support members at an optimal position in the fuel nozzle.

A combustion burner of the present invention includes a fuel nozzle configured to eject fuel gas obtained by mixing fuel and air; a secondary air nozzle configured to eject air from outside the fuel nozzle; and a flame stabilizer including a plurality of flame stabilizer main bodies disposed on a leading end of the fuel nozzle, the plurality of flame stabilizer main bodies being separated from each other by a predetermined space, and separated from an inner wall surface of the fuel nozzle by a predetermined space.

Accordingly, a recirculation area is formed on the downstream side of the flame stabilizer main bodies and, as a result, the fuel gas flowing in the fuel nozzle can maintain the combustion of the fuel. Here, the plurality of flame stabilizer main bodies are disposed so as to be separated the predetermined space from each other and are also separated the predetermined space from the inner wall surface of the fuel nozzle. The flame stabilizers therefore will not cross each other even if the number of the flame stabilizers is increased or the size of the flame stabilizer is increased. As a result, guide surfaces for forming the recirculation area can be sufficiently secured without causing interference of ignition. Furthermore, fluctuation of the flow rate and the fuel concentration of the fuel gas at the leading end of the fuel nozzle can be suppressed. As a result, interference of ignition between flame stabilizers can be suppressed and flame stabilizing performance can be enhanced.

According to the combustion burner of the present invention, the plurality of flame stabilizer main bodies are disposed in a lattice form or a staggered form.

Accordingly, interference of ignition does not occur and, also, the periphery of each individual flame stabilizer main body can be configured as an ignition surface. Thus, the plurality of flame stabilizer main bodies can be efficiently disposed in the fuel nozzle.

According to the combustion burner of the present invention, portion of the plurality of flame stabilizer main bodies that face each other are provided with a flat surface portion.

Accordingly, the solid fuel is collected in a predetermined region by the flat portions that face each other, and flame stabilizing performance can be enhanced.

According to the combustion burner of the present invention, the flame stabilizer main body forms a triangular cross-sectional shape that widens facing the downstream side in the ejection direction of the fuel gas, and a plurality of the flame stabilizer main bodies are disposed separated from each other by a predetermined space; and a spread angle of one of portions of the plurality of flame stabilizer main bodies that face each other is set to be larger.

Accordingly, the recirculation area formed by the flame stabilizer main body having the larger spread angle can be made to overlap with the recirculation area formed by the adjacent flame stabilizer main body, the flames can be spread across a wide range, and flame stabilizing performance can be enhanced.

According to the combustion burner of the present invention, among the plurality of flame stabilizer main bodies, a spread angle of the flame stabilizer main bodies disposed on a side of the center of the fuel nozzle is set to be larger than a spread angle of the flame stabilizer main bodies disposed on a side of the inner wall surface of the fuel nozzle.

Accordingly, the recirculation area formed by the flame stabilizer main body having the larger spread angle can be made to overlap with the recirculation area formed by the adjacent flame stabilizer main body, the flames can be spread across a wide range, and flame stabilizing performance can be enhanced.

According to the combustion burner of the present invention, the flame stabilizer main body forms a triangular cross-sectional shape that widens facing downstream in the ejection direction of the fuel gas, and a plurality of the flame stabilizer main bodies are disposed separated from each other by a predetermined space; and a swirl vane is disposed on the flame stabilizer main body disposed on the center side of the fuel nozzle.

Accordingly, the recirculation area formed in front of flame stabilizer main body by the swirl vane can be made to overlap with the recirculation area formed by the adjacent flame stabilizer main body, the flames can be spread across a wide range, and flame stabilizing performance can be enhanced.

A boiler of the present invention includes a furnace which forms a hollow shape and is installed vertically; a combustion burner disposed in the furnace; and a flue disposed on an upper portion of the furnace.

Accordingly, with the combustion burner, interference of ignition between the flame stabilizers can be suppressed, flame stabilizing performance can be enhanced, and boiler efficiency can be enhanced.

Advantageous Effects of Invention

According to the combustion burner and the boiler of the present invention, interference of ignition between flame stabilizers can be suppressed and flame stabilizing performance can be enhanced.

DESCRIPTION OF EMBODIMENTS

Preferred embodiments of a combustion burner and a boiler according to the present invention are described in detail below with reference to the attached drawings. Note that the present invention is not limited by these embodiments, and, when there are a plurality of embodiments, includes combinations of those various embodiments.

First Embodiment

Figure 6:
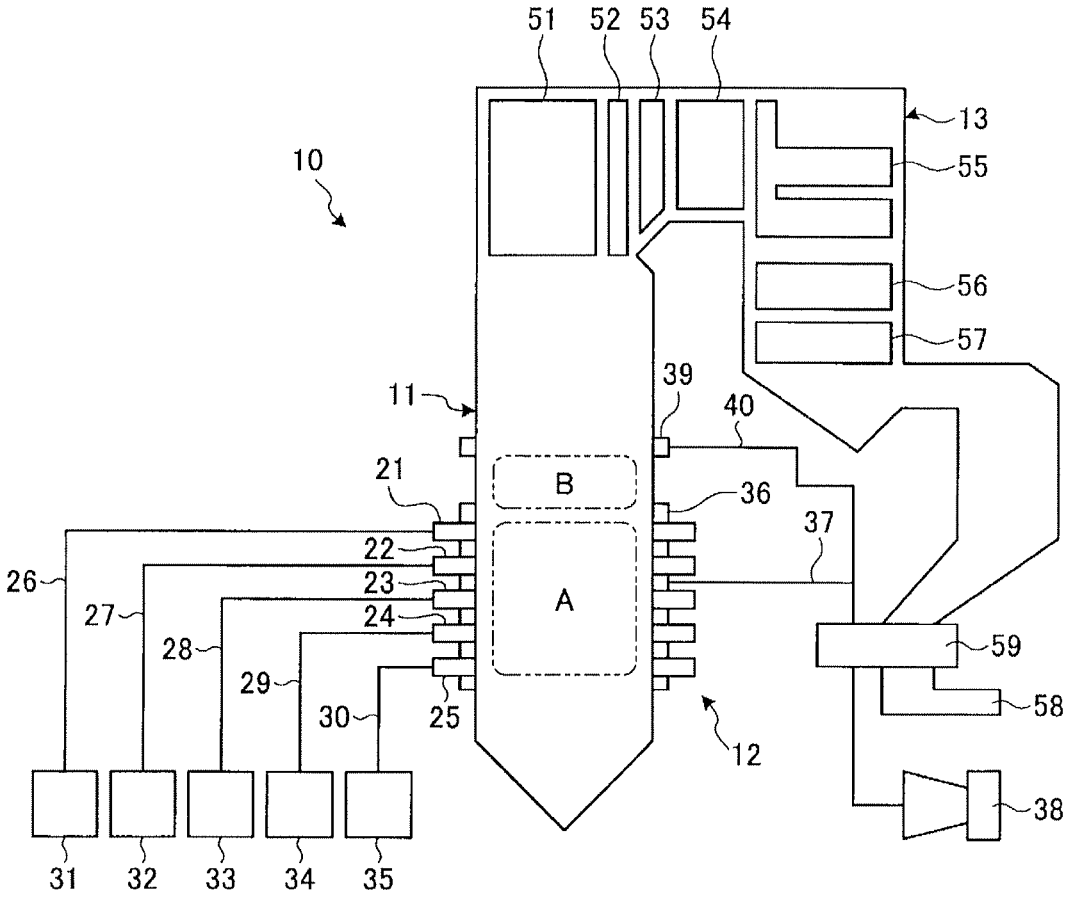
FIG. 6 is a schematic configuration diagram illustrating a coal burning boiler of the first embodiment.
Figure 7:
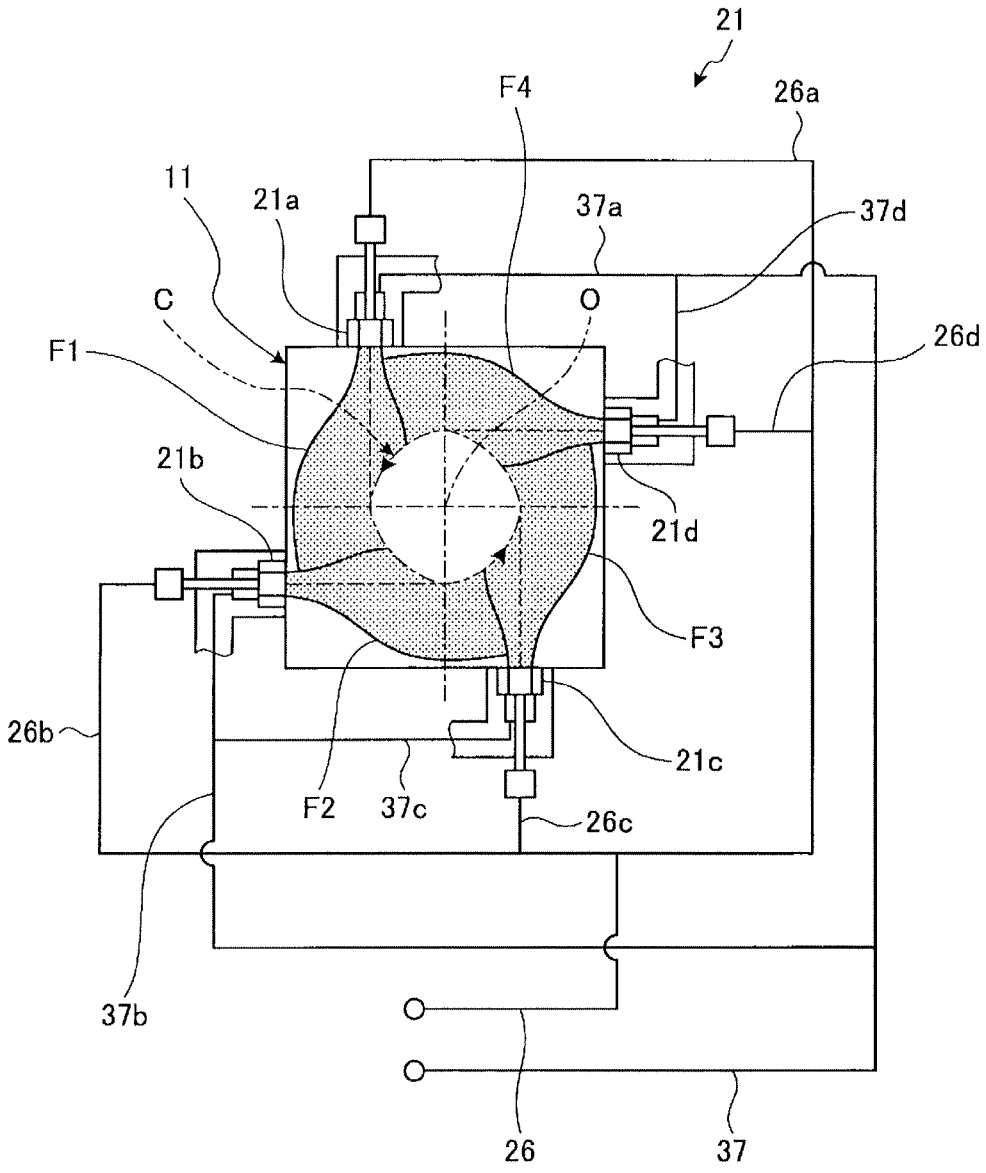
FIG. 7 is a plan view illustrating a disposal configuration of a combustion burner.

FIG. 6 is a schematic configuration diagram illustrating a coal burning boiler of a first embodiment. FIG. 7 is a plan view illustrating a disposal configuration of a combustion burner.

The boiler of the first embodiment is a pulverized coal burning boiler capable of using pulverized coal obtained by crushing coal as pulverized fuel (solid fuel), combusting the pulverized coal using a combustion burner, and collecting heat produced by the combustion.

In the first embodiment, as illustrated in FIG. 6, a coal burning boiler 10 is a conventional boiler and includes a furnace 11, a combustion device 12, and a flue 13. The furnace 11 forms a quadrangular cylinder hollow shape and is installed vertically, and the furnace wall constituting the furnace 11 is constituted by a heat transfer pipe.

The combustion device 12 is provided on a lower portion of the furnace wall (the heat transfer pipe) that constitutes the furnace 11. The combustion device 12 includes a plurality of combustion burners 21, 22, 23, 24, and 25 mounted on the furnace wall. In the present embodiment, the combustion burners 21, 22, 23, 24, and 25 are each configured as a set of four combustion burners that are arranged at equal intervals along the circumferential direction, and these five sets are disposed as five levels along the vertical direction. However, the shape of the furnace, the number of combustion burners per level, and the number of levels is not limited to this embodiment.

The combustion burners 21, 22, 23, 24, and 25 are respectively connected to pulverizers (pulverized coal machines, mills) 31, 32, 33, 34, and 35 via pulverized coal supply pipes 26, 27, 28, 29, and 30. While not illustrated in the drawings, the pulverizers 31, 32, 33, 34, and 35 have a configuration in which a pulverizing table is supported in a housing so as to be driven rotatable around a rotation axis along the vertical direction, and a plurality of pulverizing rollers are supported above the pulverizing table so as to be rotatable in conjunction with the rotation of the pulverizing table. Accordingly, when coal is fed between the plurality of pulverizing rollers and the pulverizing table, the coal is pulverized to a predetermined size, and pulverized coal that has been classified by transport air (primary air) is supplied to the combustion burners 21 and, 22, 23, 24, and 25 via the pulverized coal supply pipes 26, 27, 28, 29, and 30.

Additionally, with the furnace 11, a wind box 36 is provided at a mounting position of the combustion burners 21, 22, 23, 24, and 25. A first end of an air duct 37 is connected to the wind box 36, and a blower 38 is mounted on a second end of the air duct 37. Furthermore, with the furnace 11, an additional air nozzle 39 is provided above the mounting position of the combustion burners 21, 22, 23, 24, and 25. An end of a branch air duct 40 branching from the air duct 37 is connected to the additional air nozzle 39. Accordingly, combustion air (fuel gas combustion air/secondary air) blown from the blower 38 can be supplied to the wind box 36 via the air duct 37 and can be supplied from the wind box 36 to the combustion burners 21, 22, 23, 24, and 25. Additionally, combustion air (additional air) blown from the blower 38 can be supplied to the additional air nozzle 39 via the branch air duct 40.

The flue 13 is connected to an upper portion of the furnace 11. The flue 13 is provided with superheaters 51, 52, and 53, reheaters 54 and 55, and economizers 56 and 57 for collecting the heat of the exhaust gas. Heat exchange between the exhaust gas produced by the furnace 11 and water is carried out in the flue 13.

A gas duct 58, through which heat-exchanged exhaust gas is exhausted, is connected to the flue 13, on the downstream side of the flue 13. An air heater 59 is provided between the gas duct 58 and the air duct 37, and heat exchange is carried out between the air flowing through the air duct 37 and the exhaust gas flowing through the gas duct 58. Thus, the temperature of the combustion air supplied to the combustion burners 21, 22, 23, 24, and 25 can be raised.

Note that while not illustrated in the drawings, the gas duct 58 is provided with a denitrification device, an electrostatic precipitator, an induction blower, and a desulfurization device. Additionally, a funnel is provided on the downstream end of the gas duct 58.

A detailed description of the combustion device 12 will be given. As the combustion burners 21, 22, 23, 24, and 25 constituting the combustion device 12 have identical configurations, a description of the combustion burner 21 will be given for all of the combustion burners 21, 22, 23, 24, and 25.

As illustrated in FIG. 7, the combustion burner 21 is constituted by combustion burners 21*a*, 21*b*, 21*c*, and 21*d*, provided respectively on each of the four walls of the furnace 11. Branch pipes 26*a*, 26*b*, 26*c*, and 26*d* branching from the pulverized coal supply pipe 26 and branch pipes 37*a*, 37*b*, 37*c*, and 37*d* branching from the air duct 37 are respectively connected to the combustion burners 21*a*, 21*b*, 21*c*, and 21*d*.

As such, the combustion burners 21*a*, 21*b*, 21*c*, and 21*d* blow pulverized coal mixed air (fuel gas) obtained by mixing pulverized coal and transport air into the furnace 11, and also blow combustion air (Caol secondary air/secondary air) outside the pulverized coal mixed air into the furnace 11. Moreover, four flames F1, F2, F3, and F4 can be formed by igniting the pulverized coal mixed air and, when viewed from above in the furnace 11 (FIG. 7), these flames F1, F2, F3 and F4 form a first flame swirling flow C swirling in the counterclockwise direction.

In the coal burning boiler 10 with the configuration described above, as illustrated in FIGS. 6 and 7, when the pulverizers 31, 32, 33, 34, and 35 are driven, the solid fuel is pulverized and the resulting pulverized coal is supplied together with transport air to the combustion burners 21, 22, 23, 24, and 25 via the pulverized coal supply pipes 26, 27, 28, 29, and 30. Meanwhile, heated combustion air is supplied from the air duct 37 to the combustion burners 21, 22, 23, 24, and 25 via the wind box 36, and is also supplied to the additional air nozzle 39 via the branch air duct 40. Thus, the combustion burners 21, 22, 23, 24, and 25 blow the pulverized coal mixed air obtained by mixing the pulverized coal and the transport air into the furnace 11, and also blow the combustion air into the furnace 11. The flames can be formed by ignition when the blowing is performed. Moreover, the additional air nozzle 39 blows additional air into the furnace 11 in order to control combustion. With the furnace 11, flames are produced as a result of the combustion of the pulverized coal mixed air and the combustion air and, when flames are produced at the lower portion in the furnace 11, the fuel gas (exhaust gas) rises in the furnace 11 and is discharged through the flue 13.

Specifically, the combustion burners 21, 22, 23, 24, and 25 blow the pulverized coal mixed air and the combustion air (Coal secondary air/secondary air) into a combustion region A in the furnace 11, and ignite the air at this time in order to form the flame swirling flow C in the combustion region A. Then, the flame swirling flow C rises while swirling and reaches a reduction area B. The additional air nozzle 39 blows additional air above the reduction area B into the furnace 11. With the furnace 11, the volume of supplied air is set to be less than the theoretical air volume with respect to the volume of the supplied pulverized coal and, thus, a reduction environment is maintained inside the furnace 11. Thus, NOx produced by the combustion of the pulverized coal is reduced in the furnace 11 and, thereafter, additional air is supplied. As a result, the oxidative combustion of the pulverized coal is completed and the amount of NOx produced by the combustion of the pulverized coal is reduced.

Then, water supplied from a feed water pump (not illustrated in the drawings) is preheated by the economizers 56 and 57 and, thereafter, is heated while being supplied to a steam drum and being supplied to water pipes in the furnace wall (not illustrated in the drawings). As a result, the water becomes saturated steam, which is sent to the steam drum (not illustrated in the drawings). Furthermore, the saturated steam in the steam drum (not illustrated in the drawings) is introduced into the superheaters 51, 52, and 53, and heated by the combustion gas. The superheated steam produced by the superheaters 51, 52, and 53 is supplied to a power plant (e.g. a turbine or the like; not illustrated in the drawings). Additionally, steam removed during the expansion process at the turbine is introduced to the reheaters 54 and 55, reheated, and returned to the turbine. Note that a drum type (steam drum) furnace 11 was described, but the structure of the furnace 11 is not limited thereto.

Then, in the gas duct 58 of the flue 13, the exhaust gas which has passed through the economizers 56 and 57 is subjected to catalyst enabled NOx removal at the denitrification device, particulate matter removal at the electrostatic precipitator, and sulfur content removal at the desulfurization device (each not illustrated in the drawings). Then, the resulting exhaust gas is discharged from the flue into the atmosphere.

Figure 1:
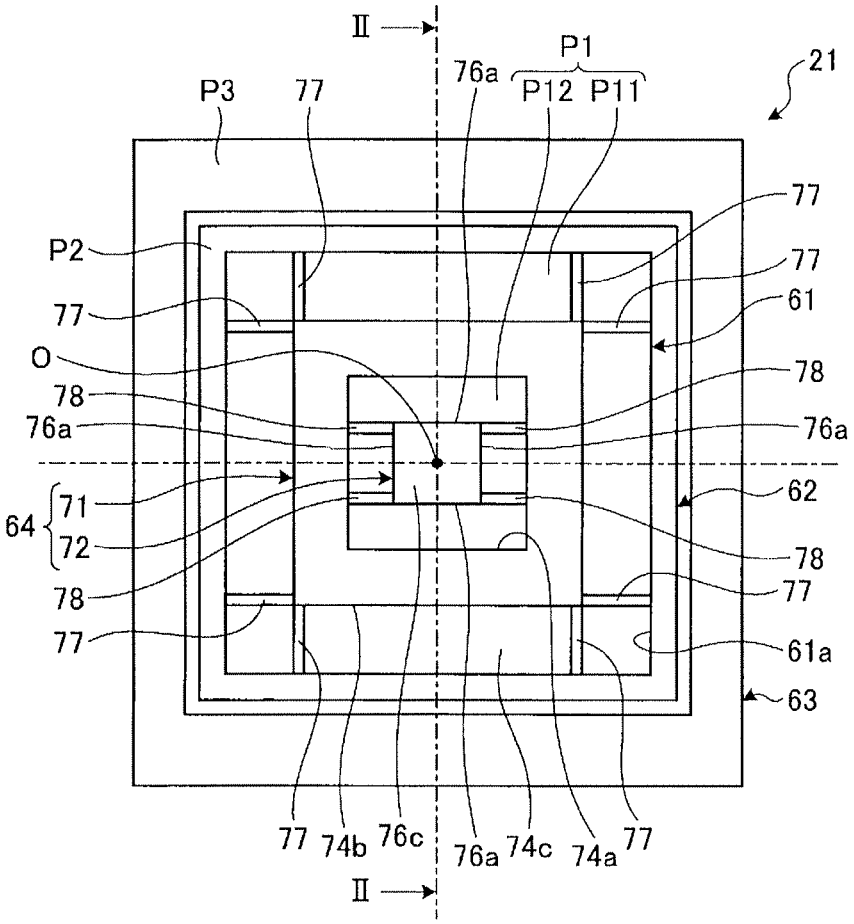
FIG. 1 is a front view of a combustion burner of a first embodiment.
Figure 2:
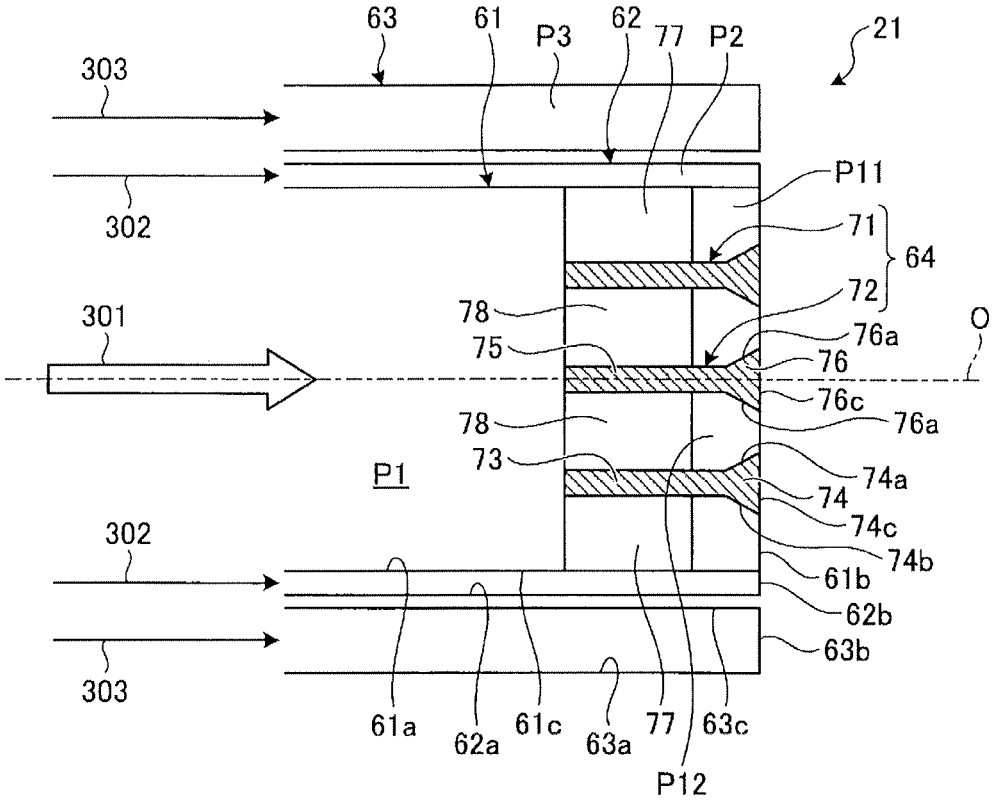
FIG. 2 is a vertical cross-sectional view of the combustion burner, taken along line II-II of FIG. 1.

Next, a detailed description is given of the combustion burner 21 (21*a*, 21*b*, 21*c*, and 21*d*) configured as described above. FIG. 1 is a front view of the combustion burner of the first embodiment. FIG. 2 is a vertical cross-sectional view of the combustion burner, taken along line II-II of FIG. 1.

As illustrated in FIGS. 1 and 2, the combustion burner 21 is provided with, from the center side, a fuel nozzle 61, a combustion air nozzle 62, and a secondary air nozzle 63. Additionally, a flame stabilizer 64 is provided in the fuel nozzle 61.

The fuel nozzle 61 is capable of ejecting pulverized fuel mixed air (hereinafter "fuel gas") 301 obtained by mixing pulverized coal (solid fuel) and transport air (primary air). The combustion air nozzle 62 is disposed outside the fuel nozzle 61, and is capable of ejecting a portion of combustion air (fuel gas combustion air) 302 on the outer peripheral side of the fuel gas 301 ejected from the fuel nozzle 61. The secondary air nozzle 63 is disposed outside the combustion air nozzle 62, and is capable of ejecting a portion of combustion air (hereinafter "secondary air") 303 on the outer peripheral side of the fuel gas combustion air 302 ejected from the combustion air nozzle 62.

The flame stabilizer 64 is disposed in the fuel nozzle 61, at the leading end, that is, on the downstream side in the flow direction of the fuel gas 301, of the fuel nozzle 61. As such, the flame stabilizer 64 functions as a member for igniting the fuel gas 301 and stabilizing the flame thereof. The flame stabilizer 64 is constituted by a first flame stabilizer main body 71 and a second flame stabilizer main body 72. The first flame stabilizer main body 71 is disposed on the leading end of the fuel nozzle 61 and is separated by a predetermined space (gap) from an inner wall surface 61*a* of the fuel nozzle 61. Additionally, the first flame stabilizer main body 71 forms a ring shape having an axial line O along the ejection direction of the fuel gas 301 (the center line of the fuel nozzle 61) as a center. The second flame stabilizer main body 72 is disposed inside the first flame stabilizer main body 71 and is separated by a predetermined space (gap) from the first flame stabilizer main body 71. Additionally, the second flame stabilizer main body 72 forms a rod shape having the axial line O along the ejection direction of the fuel gas 301 (the center line of the fuel nozzle 61) as a center.

The fuel nozzle 61 and the combustion air nozzle 62 form elongated tubular structures. The fuel nozzle 61 forms a fuel gas flow path P1, extending in the longitudinal direction with a uniform flow path cross-sectional shape, from four flat inner wall surfaces 61*a*. Additionally, a rectangular opening 61*b* is provided at the leading end (the downstream side end) of the fuel gas flow path P1. The combustion air nozzle 62 forms a combustion air flow path P2, extending in the longitudinal direction with a uniform flow path cross-sectional shape, from four flat outer wall surfaces 61*c* of the fuel nozzle 61 and four flat inner wall surfaces 62*a*. Additionally, an opening 62*b* with a rectangular ring shape is provided at the leading end (the downstream side end) of the air flow path P2. As such, the fuel nozzle 61 and the combustion air nozzle 62 are configured as double pipe structures.

The secondary air nozzle 63 forms an elongated tubular structure and is disposed outside the fuel nozzle 61 and the combustion air nozzle 62. The secondary air nozzle 63 forms an independent double pipe structure, and is disposed outside the combustion air nozzle 62, separated from the combustion air nozzle 62 by a predetermined space. The secondary air nozzle 63 forms a secondary air flow path P3, extending in the longitudinal direction with a uniform flow path cross-sectional shape, from four flat inner wall surfaces 63*a* and four flat outer wall surfaces 63*c*. Additionally, an opening 63*b* with a rectangular ring shape is provided at the leading end (the downstream side end) of the secondary air flow path P3.

As such, the opening 62*b* of the combustion air nozzle 62 (the combustion air flow path P2) is disposed outside the opening 61*b* of the fuel nozzle 61 (the fuel gas flow path P1), and the opening 63*b* of the secondary air nozzle 63 (the secondary air flow path P3) is disposed outside the opening 62*b* of the combustion air nozzle 62 (the combustion air flow path P2), separated from the combustion air nozzle 62 by a predetermined space. The fuel nozzle 61, the combustion air nozzle 62, the secondary air nozzle 63, and the flame stabilizer 64 are disposed such that the openings 61*b*, 62*b*, and 63*b* are aligned on the same plane and at the same position in the flow direction of the fuel gas 301 and the air.

Note that the secondary air nozzle 63 may be formed without an independent double pipe structure and without a gap from the outside of the combustion air nozzle 62. Additionally, the secondary air nozzle 63 may be disposed without a rectangular ring shape and, instead, in four sections, namely above, below, and to the left and right of the combustion air nozzle 62.

The first flame stabilizer main body 71 forms a rectangular (quadrangular) ring shape when viewed from the front (the direction illustrated in FIG. 1), and forms a quadrangular cylindrical shape along the flow direction of the fuel gas 301. In a cross-section taken along the width direction (FIG. 2), the first flame stabilizer main body 71 is constituted by a flat portion 73 having a constant width, and a widened portion 74 provided integrally with the front end (the downstream end in the flow direction of the fuel gas 301) of the flat portion 73. The width of the flat portion 73 is constant along the flow direction of the fuel gas 301. The width of the widened portion 74 increases toward the flow direction of the fuel gas 301. A cross-section of the widened portion 74 forms a substantially isosceles triangle shape. A base end is connected to the flat portion 73, the width of the leading end increases toward the downstream side in the flow direction of the fuel gas 301, and the leading edge is a surface that is orthogonal to the flow direction of the fuel gas 301. Specifically, the widened portion 74 includes a first guide surface 74*a* on an inner side that forms a quadrangular ring shape and is inclined toward the center line O side with respect to the flow direction of the fuel gas 301, a second guide surface 74*b* on an outer side that forms a quadrangular ring shape and is inclined away from the center line O side with respect to the flow direction of the fuel gas 301, and an end surface 74*c* on the front end side that forms a quadrangular ring shape. In this case, the widened portion 74 has a width that is constant along the longitudinal direction thereof, but the width may be varied between the vertical sides and the horizontal sides of the four sides, or may be appropriately configured depending on the shape of the fuel nozzle 61. Additionally, while the first guide surface 74*a*, the second guide surface 74*b*, and the end surface 74*c* are preferably flat surfaces, they may also be surfaces bent or curved into concave or convex forms.

On the other hand, the second flame stabilizer main body 72 forms a rectangular (quadrangular) pillar shape when viewed from the front (the direction illustrated in FIG. 1), and forms a quadrangular rod shape along the flow direction of the fuel gas 301. In a cross section taken along the width direction (FIG. 2), the second flame stabilizer main body 72 is constituted by a flat portion 75 having a constant width, and a widened portion 76 provided integrally with the front end (the downstream end in the flow direction of the fuel gas 301) of the flat portion 75. The width and height of the flat portion 75 are constant along the flow direction of the fuel gas 301. The width and height of the widened portion 76 increase toward the flow direction of the fuel gas 301. When viewed from above and from the side (or in a cross section), the widened portion 76 forms a substantially isosceles triangle shape. A base end is connected to the flat portion 75, the width of the leading end increases toward the downstream side in the flow direction of the fuel gas 301, and the leading edge is a surface that is orthogonal to the flow direction of the fuel gas 301. Specifically, the widened portion 76 includes guide surfaces 76*a* on outer sides that form quadrangular rod shapes and are inclined away from the center line O side with respect to the flow direction of the fuel gas 301, and an end surface 76*c* on the front end side that forms a quadrangular shape. In this case, while the guide surfaces 76*a* and the end surface 74*c* are preferably flat surfaces, they may also be surfaces bent or curved into concave or convex forms.

As described above, in this case, the first flame stabilizer main body 71 is disposed separated a predetermined space from the inner wall surface 61*a* of the fuel nozzle 61. The predetermined space is a gap equal to at least the width of the widened portion 74 of the first flame stabilizer main body 71, or is a gap of a width such that the widened portion 74 of the first flame stabilizer main body 71 does not interfere (contact) the inner wall surface 61*a* of the fuel nozzle 61 as a result of thermal elongation. Additionally, the second flame stabilizer main body 72 is disposed separated a predetermined space from the inside of the first flame stabilizer main body 71. The predetermined space is a gap equal to at least the width of the widened portion 76 of the second flame stabilizer main body 72, or is a gap of a width such that the widened portion 76 of the second flame stabilizer main body 72 does not interfere (contact) the first flame stabilizer main body 71 as a result of thermal elongation.

The first and second flame stabilizer main bodies 71 and 72 are disposed in the fuel nozzle 61 as the flame stabilizer 64 and, as such, the fuel gas flow path P1 is divided into two regions. Specifically, the fuel gas flow path P1 is divided into a first fuel gas flow path P11 between the first flame stabilizer main body 71 and the inner wall surface 61*a* of the fuel nozzle 61, and a second fuel gas flow path P12 between the first flame stabilizer main body 71 and the second flame stabilizer main body 72. Moreover, the widened portions 74 and 76 are provided on the leading ends of the first and second flame stabilizers main bodies 71 and 72, respectively, and these widened portions 74 and 76 are disposed such that the end surfaces 74*c* and 76*c* are aligned on the same plane and at the same position in the flow direction of the fuel gas 301 as the opening 61*b* of the fuel nozzle 61.

The outer periphery of the first flame stabilizer main body 71 is supported on the inner wall surface 61*a* of the fuel nozzle 61 by a plurality (eight in the present embodiment) of support members 77. The support members 77 support the first flame stabilizer main body 71 at the vicinities of the four corners of the first flame stabilizer main body 71. Each of the support members 77 connects the inner wall surface 61*a* of the fuel nozzle 61 to a portion of the flat portion 73 of the first flame stabilizer main body 71. The support members 77 are not provided in the region of the widened portion 74. Additionally, the outer periphery of the second flame stabilizer main body 72 is supported on the first flame stabilizer main body 71 by a plurality (four in the present embodiment) of support members 78. The support members 78 support the vicinities of the four corners of the second flame stabilizer main body 72. Each of the support members 78 connects the inner wall surface of the first flame stabilizer main body 71 to a portion of the flat portion 75 of the second flame stabilizer main body 72. The support members 78 are not provided in the region of the widened portion 76.

Note that the support members 77 and 78 are configured to support the flame stabilizer main bodies 71 and 72 and, as such, do not affect the flow of the fuel gas 301 or the flame stabilizing thereof. Therefore, the support members 77 and 78 are configured with a width (thin thickness) that is, to the greatest extent possible, smaller than the width (the thickness) of the flame stabilizer main bodies 71 and 72 (flat portions 73 and 75, and the widened portions 74 and 76). Additionally, in the present embodiment, a configuration is described in which the flat portions 73 and 75 of the flame stabilizer main bodies 71 and 72 are supported by the support members 77 and 78, but the support members 77 and 78 may support the widened portions 74 and 76, or may support both the flat portions 73 and 75 and the widened portion 76. Moreover, the supporting positions in the circumferential direction where the support members 77 and 78 support the flame stabilizer main bodies 71 and 72 are not limited to this embodiment.

In the combustion burner 21 configured as described above, the fuel gas (pulverized coal and primary air) 301 flows through the fuel gas flow path P1 of the fuel nozzle 61, and is ejected from the opening 61*b* into the furnace 11 (see FIG. 2). The fuel gas combustion air 302 flows through the combustion air flow path P2 of the combustion air nozzle 62 and is ejected from the opening 62*b* outside of the fuel gas 301. The secondary air 303 flows through the secondary air flow path P3 of the secondary air nozzle 63 and is ejected from the opening 63*b* outside of the fuel gas combustion air 302. Here, the fuel gas (pulverized coal and primary air) 301, the fuel gas combustion air 302, and the secondary air 303 are ejected as straight flows along the burner axis direction (the center line O) without swirling.

Here, the fuel gas 301 is split by the first flame stabilizer main body 71 and the second flame stabilizer main body 72 at the opening 61*b* of the fuel nozzle 61 and flows, and is ignited here and combusts, thus becoming combustion gas. Additionally, the fuel gas 301 combustion air is ejected on the outer periphery of the fuel gas 301 to promote the combustion of the fuel gas 301. Furthermore, the secondary air 303 is ejected on the outer periphery of the combustion flames to adjust the proportions of the fuel gas combustion air and the secondary air 303 and achieve the optimal combustion.

With the flame stabilizer 64, the widened portions 74 and 76 of the first flame stabilizer main body 71 and the second flame stabilizer main body 72 form split shapes and, as such, the fuel gas 301 flows along the guide surfaces 74*a*, 74*b*, and 76*a* of the widened portions 74 and 76, and flows around to the end surface 74*c* and 76*c* sides so as to form a recirculation area in front of the end surfaces 74*c* and 76*c*. As such, ignition of the fuel gas 301 and flame stabilization thereof are carried out in the recirculation area, and internal flame stabilization of the combustion flames (the flame stabilization in the central region on the center line O side of the fuel nozzle 61) is realized. As a result, the temperature of the outer periphery of the combustion flames is lower, the temperature of the outer periphery of the combustion flames in high-oxygen atmosphere can be lowered by the secondary air 303, and the amount of NOx produced in the outer periphery of the combustion flames is reduced.

The first flame stabilizer main body 71 forms a ring shape, the second flame stabilizer main body 72 forms a rod shape. The fuel nozzle 61, the first flame stabilizer main body 71, and the second flame stabilizer main body 72 are not connected and, instead, are separated at the predetermined spaces described above via the fuel gas flow paths P11 and P12. As such, the fuel gas 301 can form a recirculation area that has a multiple ring shape by the guide surfaces 74*a* and 74*b* of the first flame stabilizer main body 71 and the guide surfaces 76*a* of the second flame stabilizer main body 72, and areas where the recirculation area cannot be formed are reduced. Thus, flame stabilizing performance can be enhanced. Additionally, interference of the flame stabilization by the first flame stabilizer main body 71 with the flame stabilization by the second flame stabilizer main body 72 can be suppressed.

Figure 3:
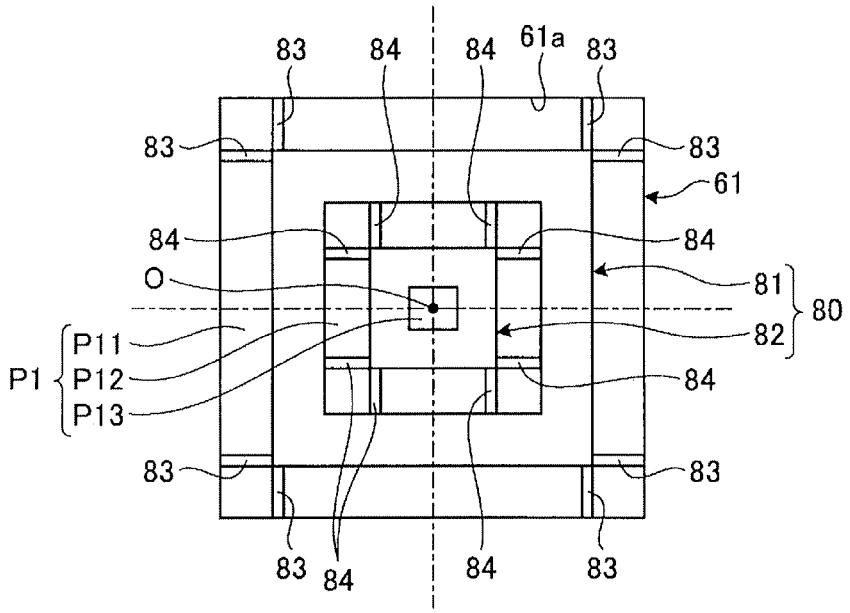
FIG. 3 is a front view illustrating a first modified example of the combustion burner of the first embodiment.
Figure 4:
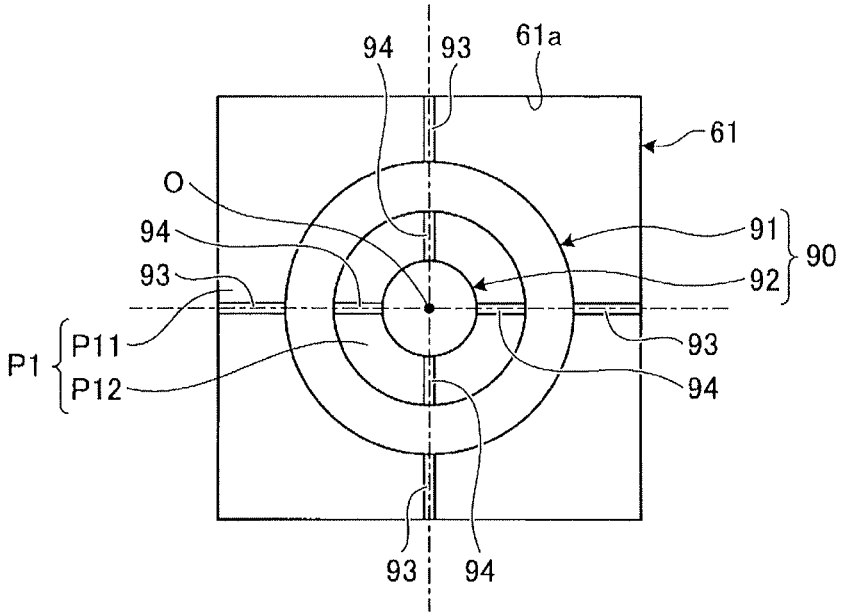
FIG. 4 is a front view illustrating a second modified example of the combustion burner of the first embodiment.
Figure 5:
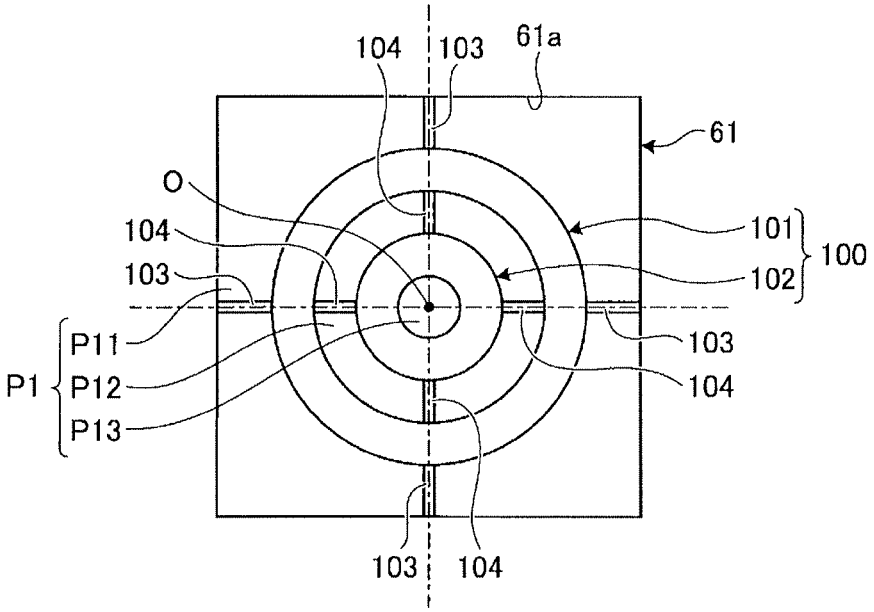
FIG. 5 is a front view illustrating a third modified example of the combustion burner of the first embodiment.

Note that, with the combustion burner 21, the configuration of the flame stabilizer 64 is not limited to the embodiment described above. FIG. 3 is a front view illustrating a first modified example of the combustion burner of the first embodiment. FIG. 4 is a front view illustrating a second modified example of the combustion burner of the first embodiment. FIG. 5 is a front view illustrating a third modified example of the combustion burner of the first embodiment.

As illustrated in FIG. 3, a flame stabilizer 80 is disposed on the leading end, that is, on the downstream side in the flow direction of the fuel gas, of the fuel nozzle 61. The flame stabilizer 80 functions as a member for igniting the fuel gas of the fuel nozzle 61 and stabilizing the flames thereof. The flame stabilizer 80 is constituted by a first flame stabilizer main body 81 and a second flame stabilizer main body 82. As with the first flame stabilizer main body 71 of the first embodiment, the first flame stabilizer main body 81 is disposed on the leading end of the fuel nozzle 61 and is separated by a predetermined space (gap) from an inner wall surface 61*a* of the fuel nozzle 61. Additionally, the first flame stabilizer main body 81 forms a rectangular ring shape having an axial line O along the ejection direction of the fuel gas (the center line of the fuel nozzle 61) as a center. The second flame stabilizer main body 82 is disposed inside the first flame stabilizer main body 81 and is separated by a predetermined space (gap) from the first flame stabilizer main body 81. Additionally, the second flame stabilizer main body 82 forms a rectangular ring shape having the axial line O along the ejection direction of the fuel gas (the center line of the fuel nozzle 61) as a center.

The first and second flame stabilizer main bodies 81 and 82 are disposed in the fuel nozzle 61 as the flame stabilizer 80 and, as such, the fuel gas flow path P1 is divided into three regions. Specifically, the fuel gas flow path P1 is divided into a first fuel gas flow path P11 between the first flame stabilizer main body 81 and the inner wall surface 61*a* of the fuel nozzle 61, a second fuel gas flow path P12 between the first flame stabilizer main body 81 and the second flame stabilizer main body 82, and a third fuel gas flow path P13 inside the second flame stabilizer main body 82. Note that, while not illustrated in the drawings, a widened portion is provided at the leading end of each of the first and second flame stabilizer main bodies 81 and 82.

The outer periphery of the first flame stabilizer main body 81 is supported on the inner wall surface 61*a* of the fuel nozzle 61 by a plurality (eight in the present embodiment) of support members 83. Additionally, the outer periphery of the second flame stabilizer main body 82 is supported on the first flame stabilizer main body 81 by a plurality (eight in the present embodiment) of support members 84.

As illustrated in FIG. 4, a flame stabilizer 90 is disposed on the leading end, that is, on the downstream side in the flow direction of the fuel gas, of the fuel nozzle 61. The flame stabilizer 90 functions as a member for igniting the fuel gas of the fuel nozzle 61 and stabilizing the flames thereof. The flame stabilizer 90 is constituted by a first flame stabilizer main body 91 and a second flame stabilizer main body 92. The first flame stabilizer main body 91 is disposed on the leading end of the fuel nozzle 61 and is separated by a predetermined space (gap) from an inner wall surface 61*a* of the fuel nozzle 61. Additionally, the first flame stabilizer main body 91 forms a round ring shape having an axial line O along the ejection direction of the fuel gas (the center line of the fuel nozzle 61) as a center. The second flame stabilizer main body 92 is disposed inside the first flame stabilizer main body 91 and is separated by a predetermined space (gap) from the first flame stabilizer main body 91. Additionally, the second flame stabilizer main body 92 forms a circular pillar shape having the axial line O along the ejection direction of the fuel gas (the center line of the fuel nozzle 61) as a center.

The first and second flame stabilizer main bodies 91 and 92 are disposed in the fuel nozzle 61 as the flame stabilizer 90 and, as such, the fuel gas flow path P1 is divided into two regions. Specifically, the fuel gas flow path P1 is divided into a first fuel gas flow path P11 between the first flame stabilizer main body 91 and the inner wall surface 61*a* of the fuel nozzle 61, and a second fuel gas flow path P12 between the first flame stabilizer main body 91 and the second flame stabilizer main body 92. Note that, while not illustrated in the drawings, a widened portion is provided at the leading end of each of the first and second flame stabilizer main bodies 91 and 92.

The outer periphery of the first flame stabilizer main body 91 is supported on the inner wall surface 61*a* of the fuel nozzle 61 by a plurality (four in the present embodiment) of support members 93. Additionally, the outer periphery of the second flame stabilizer main body 92 is supported on the first flame stabilizer main body 91 by a plurality (four in the present embodiment) of support members 94.

As illustrated in FIG. 5, a flame stabilizer 100 is disposed on the leading end, that is, on the downstream side in the flow direction of the fuel gas, of the fuel nozzle 61. The flame stabilizer 100 functions as a member for igniting the fuel gas of the fuel nozzle 61 and stabilizing the flames thereof. The flame stabilizer 100 is constituted by a first flame stabilizer main body 101 and a second flame stabilizer main body 102. As with the first flame stabilizer main body 91, the first flame stabilizer main body 101 is disposed on the leading end of the fuel nozzle 61 and is separated by a predetermined space (gap) from an inner wall surface 61*a* of the fuel nozzle 61. Additionally, the first flame stabilizer main body 101 forms a round ring shape having an axial line O along the ejection direction of the fuel gas (the center line of the fuel nozzle 61) as a center. The second flame stabilizer main body 102 is disposed inside the first flame stabilizer main body 101 and is separated by a predetermined space (gap) from the first flame stabilizer main body 101. Additionally, the second flame stabilizer main body 102 forms a round ring shape having the axial line O along the ejection direction of the fuel gas (the center line of the fuel nozzle 61) as a center.

The first and second flame stabilizer main bodies 101 and 102 are disposed in the fuel nozzle 61 as the flame stabilizer 100 and, as such, the fuel gas flow path P1 is divided into three regions. Specifically, the fuel gas flow path P1 is divided into a first fuel gas flow path P11 between the first flame stabilizer main body 101 and the inner wall surface 61*a* of the fuel nozzle 61, a second fuel gas flow path P12 between the first flame stabilizer main body 101 and the second flame stabilizer main body 102, and a third fuel gas flow path P13 inside the second flame stabilizer main body 102. Note that, while not illustrated in the drawings, a widened portion is provided at the leading end of each of the first and second flame stabilizer main bodies 101 and 102.

The outer periphery of the first flame stabilizer main body 101 is supported on the inner wall surface 61*a* of the fuel nozzle 61 by a plurality (four in the present embodiment) of support members 103. Additionally, the outer periphery of the second flame stabilizer main body 102 is supported on the first flame stabilizer main body 101 by a plurality (four in the present embodiment) of support members 104.

Note that the shape of the flame stabilizer main bodies is not limited to quadrangular ring shapes and round ring shapes, and polygonal ring shapes or elliptical ring shapes may be used. Additionally, combinations of the first flame stabilizer main body and the second flame stabilizer main body are not limited to combinations where the shapes are the same. For example, a configuration is possible in which a combination of different shapes, such as a quadrangular ring shape and a round ring shape, is used. Furthermore, the combination of flame stabilizers is not limited to two flame stabilizers, and one flame stabilizer may be used or combinations of three of more flame stabilizers may be used.

Thus, the combustion burner of the first embodiment is provided with the fuel nozzle 61 configured to eject fuel gas obtained by mixing pulverized coal and air; the combustion air nozzle 62 configured to eject air from outside the fuel nozzle 61; and the flame stabilizer 64 (80, 90, and 100) including the first flame stabilizer main body 71 (81, 91, and 101) disposed on the leading end of the fuel nozzle 61 and separated by the predetermined space from the inner wall surface 61*a* of the fuel nozzle 61, the first flame stabilizer main body 71 (81, 91, and 101) forming a ring shape having an axial line along the ejection direction of the fuel gas as a center line O.

Accordingly, a recirculation area is formed on the downstream side of the first flame stabilizer main body 71 and, as a result, the fuel gas flowing in the fuel nozzle 61 can maintain the combustion of the fuel gas (pulverized coal). Here, because the first flame stabilizer main body 71 forms a ring shape, the flame stabilizers will not cross each other even if the number of first flame stabilizer main body 71 or the size of the first flame stabilizer main body 71 is increased. As a result, guide surfaces for forming the recirculation area can be sufficiently secured without causing interference of ignition. Additionally, due to the fact that the ignition surface is connected by a single line, it is possible to cause broad ignition throughout the recirculation area of the first flame stabilizer main body 71 by ignition at one portion. Furthermore, fluctuation of the flow rate and the fuel concentration of the fuel gas at the leading end of the fuel nozzle 61 can be suppressed. As a result, interference of ignition between flame stabilizers can be suppressed and flame stabilizing performance can be enhanced.

On the other hand, with a conventional flame stabilizer having a lattice form, it is necessary to increase the number of flame stabilizers or increase the size of the flame stabilizer in order to enhance flame stability, and interference of ignition occurs due to the flame stabilizers crossing each other. If the size of the flame stabilizer is increased, the flow rate of the fuel gas and the pulverized coal concentration at the leading end of the fuel nozzle will fluctuate and, consequently, flame may not be maintained evenly across the flame stabilizer. Specifically, with flame stabilizers having a lattice form, the fuel gas does not contact the crossing portions and, consequently, useless regions that do not contribute to flame stabilization are formed and the blockage rate at the leading end of the fuel nozzle increases.

With the combustion burner of the first embodiment, the second flame stabilizer main body 72 (82, 92, and 102) is provided as the flame stabilizer 64, and is separated from the inside of the first flame stabilizer main body 71 by the predetermined space. Accordingly, the recirculation area can be formed in the center portion of the fuel nozzle 61 and internal flame stabilizing performance can be enhanced by the second flame stabilizer main body 72.

With the combustion burner of the first embodiment, the first flame stabilizer main body 71 (81, 91, and 101) is configured as a rectangular ring shape or a round ring shape. Accordingly, the shape of the first flame stabilizer main body 71 can be optimized depending on the shape of the fuel nozzle 61.

With the combustion burner of the first embodiment, the outer periphery of the first flame stabilizer main body 71 (81, 91, and 101) is supported on the inner wall surface 61*a* of the fuel nozzle 61 by the plurality of support members 77 (83, 93, and 103). Accordingly, the first flame stabilizer main body 71 can be appropriately supported by the support members 77 at an optimal position in the fuel nozzle 61.

With the combustion burner of the first embodiment, the second flame stabilizer main body 72 (102) is configured with a ring shape having the axial line O as a center. Accordingly, the second flame stabilizer main body 72 that forms a ring shape is disposed inside the first flame stabilizer main body 71, the second flame stabilizer main body 72 being separated the predetermined space from the first flame stabilizer main body 71. As a result, the recirculation area can be formed in a wide region in the center portion of the fuel nozzle 61 and internal flame stabilizing performance can be enhanced.

A boiler of the first embodiment is provided with the furnace 11 which forms a hollow shape and is installed vertically; the combustion device 12 disposed in the furnace 11; and the flue 13 disposed on an upper portion of the furnace 11. Due to the fact that the combustion device 12 includes the combustion burner 21 described above, interference of ignition between the flame stabilizers can be suppressed, flame stabilizing performance can be enhanced, and boiler efficiency can be enhanced.

Second Embodiment

Figure 8:
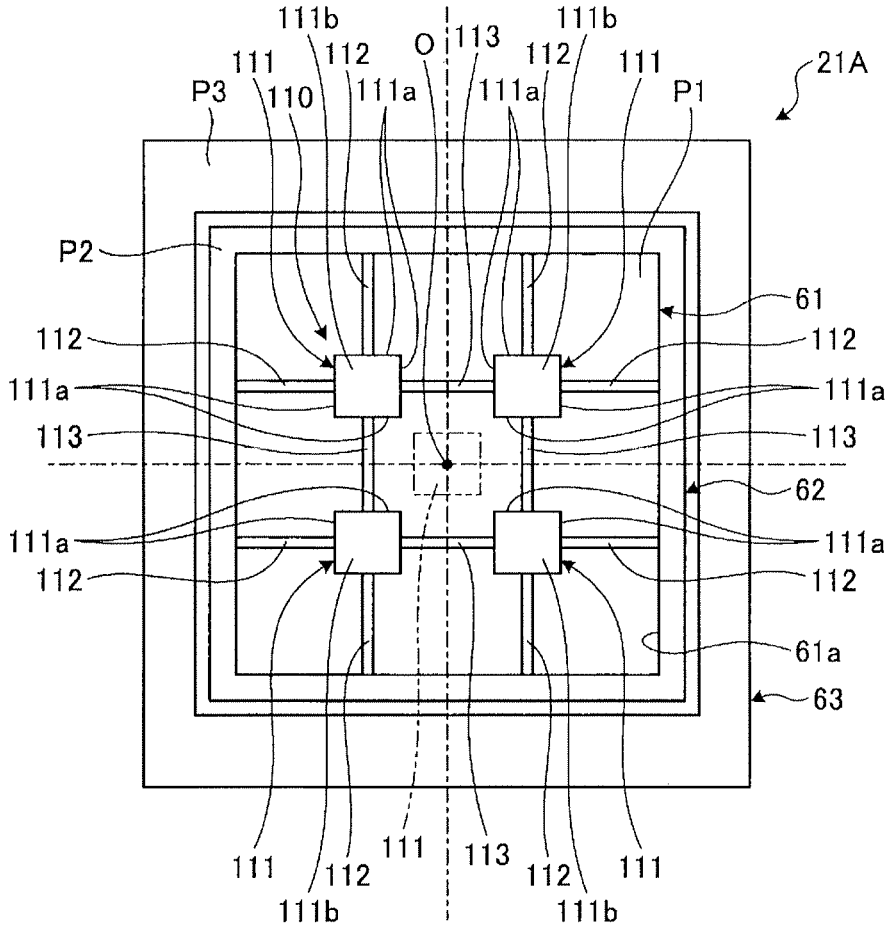
FIG. 8 is a front view of a combustion burner of a second embodiment.

FIG. 8 is a front view of a combustion burner of a second embodiment. Note that the same reference numerals are given to members having the same functions as the embodiments described above and detailed description thereof will be omitted.

In the second embodiment, as illustrated in FIG. 8, a combustion burner 21A is provided with, from the center side, a fuel nozzle 61, a combustion air nozzle 62, and a secondary air nozzle 63. Additionally, a flame stabilizer 110 is provided in the fuel nozzle 61.

The fuel nozzle 61 is capable of ejecting fuel gas obtained by mixing pulverized coal and transport air. The combustion air nozzle 62 is capable of ejecting fuel gas combustion air on the outer peripheral side of the fuel gas ejected from the fuel nozzle 61. The secondary air nozzle 63 is capable of ejecting secondary air 303 on the outer peripheral side of the fuel gas combustion air ejected from the combustion air nozzle 62.

The flame stabilizer 110 is disposed in the fuel nozzle 61, at the leading end, that is, on the downstream side in the flow direction of the fuel gas, of the fuel nozzle 61. As such, the flame stabilizer 110 functions as a member for igniting the fuel gas and stabilizing the flame thereof. The flame stabilizer 110 is constituted by a plurality (four in the present embodiment) of flame stabilizer main bodies 111, and the plurality of flame stabilizer main bodies 111 are disposed separated a predetermined space (gap) from each other and are also disposed separated a predetermined space from the inner wall surface 61*a* of the fuel nozzle 61. Additionally, each of the flame stabilizer main bodies 111 forms a rod shape parallel to the axial line (center line of the fuel nozzle 61) O along the ejection direction of the fuel gas.

The flame stabilizer main bodies 111 form the same shape and, each forms a rectangular (quadrangular) shape when viewed from the front (the direction illustrated in FIG. 8), and form a quadrangular cylindrical shape along the flow direction of the fuel gas. While not illustrated in the drawings, the flame stabilizer main bodies 111 are constituted by a flat portion having a constant width and height, and a widened portion provided integrally with the front end (the downstream end in the flow direction of the fuel gas) of the flat portion. The width and height of the widened portion increase toward the flow direction of the fuel gas. The cross section of the widened portion forms a substantially isosceles triangle shape. A base end is connected to the flat portion, the width of the leading end increases toward the downstream side in the flow direction of the fuel gas, and the leading edge is a surface that is orthogonal to the flow direction of the fuel gas. As such, the widened portion includes guide surfaces 111*a* inclined so as to spread in four directions, and an end surface 111*b* on the front end side. In this case, while the guide surfaces and the end surface are preferably flat surfaces, they may also be surfaces bent or curved into concave or convex forms.

As described above, in this case, the flame stabilizer main bodies 111 are disposed separated a predetermined space from each other. The predetermined space is a gap equal to at least the width of the widened portion of the flame stabilizer main bodies 111, or is a gap of a width such that the widened portion of the flame stabilizer main bodies 111 do not interfere (contact) the other flame stabilizer main bodies 111 or the inner wall surface 61*a* of the fuel nozzle 61 as a result of thermal elongation.

The plurality of flame stabilizer main bodies 111 are disposed in a lattice form as the flame stabilizer 110 in the fuel nozzle 61. In this case, the spaces between the plurality of flame stabilizer main bodies 111 and the spaces between the flame stabilizer main bodies 111 and the fuel nozzle 61 are configured to be the same size. As such, guide surfaces 111*a* of portions of the plurality of flame stabilizer main bodies 111 that face each other are flat portions. Note that as illustrated by the long dashed double-short dashed line in FIG. 8, a flame stabilizer main body 111 may also be disposed at a position on the axial line O along the ejection direction of the fuel gas. Moreover, the widened portion is provided at the leading ends of the flame stabilizer main bodies 111, and the widened portion is disposed such that the end surfaces are aligned on the same plane and at the same position in the flow direction of the fuel gas as the opening of the fuel nozzle 61.

The outer peripheries of the plurality of flame stabilizer main bodies 111 are supported on the inner wall surface 61*a* of the fuel nozzle 61 by a plurality (eight in the present embodiment) of support members 112. Each of the support members 112 connects the inner wall surface 61*a* of the fuel nozzle 61 to a portion of the flat portion of the flame stabilizer main bodies 111. The support members 112 are not provided in the region of the widened portion. Additionally, the plurality of flame stabilizer main bodies 111 are connected to each other by a plurality (four in the present embodiment) of support members 113. Each of the support members 113 connects the flat portions of the flame stabilizer main bodies 111 to each other. The support members 113 are not provided in the region of the widened portion.

As such, in the combustion burner 21A, the fuel gas flows through the flow path of the fuel nozzle 61, and is ejected from the opening into the furnace 11 (see FIG. 2). The fuel gas combustion air flows through the flow path of the combustion air nozzle 62 and is ejected from the opening outside of the fuel gas. The secondary air 303 flows through the flow path of the secondary air nozzle 63 and is ejected from the opening outside of the fuel gas combustion air. Here, the fuel gas (pulverized coal and primary air), the fuel gas combustion air, and the secondary air 303 are ejected as straight flows along the burner axis direction (the center line O) without swirling. Moreover, the fuel gas flows along the plurality of flame stabilizer main bodies 111 at the opening of the fuel nozzle 61, and is ignited here and combusts, thus becoming combustion gas. Additionally, the fuel gas combustion air is ejected on the outer periphery of the fuel gas to promote the combustion of the fuel gas. Furthermore, the secondary air is ejected on the outer periphery of the combustion flames to adjust the proportions of the fuel gas combustion air and the secondary air and achieve the optimal combustion.

With the flame stabilizer 110, the widened portions of the plurality of flame stabilizer main bodies 111 form split shapes and, as such, the fuel gas flows along the guide surfaces 111*a* of the widened portions, and flows around to the end surface 111*b* side so as to form a recirculation area in front of the end surface 111*b*. As such, ignition of the fuel gas and flame stabilization thereof is carried out in the recirculation area, and internal flame stabilization of the combustion flames is realized. As a result, the temperature of the outer periphery of the combustion flames lowers, the temperature of the outer periphery of the combustion flames in high-oxygen atmosphere can be lowered by the secondary air, and the amount of NOx produced in the outer periphery of the combustion flames is reduced.

The plurality of flame stabilizer main bodies 111 are scattered in a lattice form, separated by the predetermined space. As such, the fuel gas can form a plurality of recirculation areas in the fuel nozzle 61 by the guide surfaces 111*a* of the flame stabilizer main bodies 111, and areas where the recirculation area cannot be formed are reduced. Thus, flame stabilizing performance can be enhanced.

Figure 9:
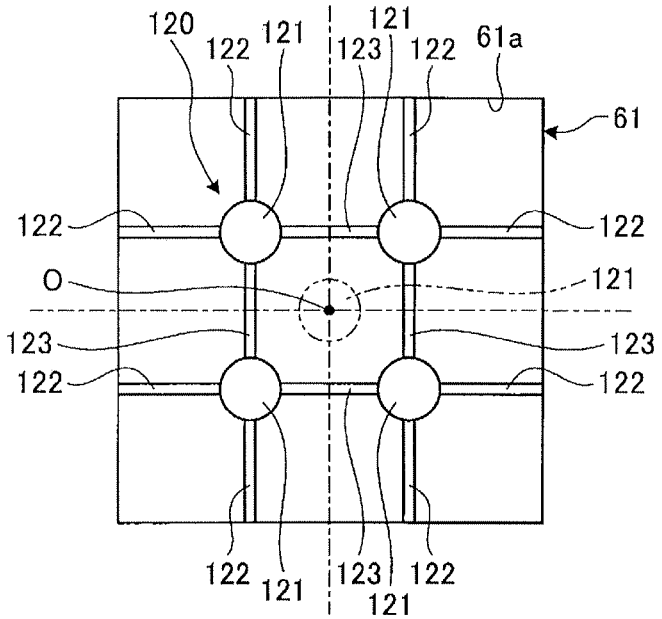
FIG. 9 is a front view illustrating a first modified example of the combustion burner of the second embodiment.
Figure 10:
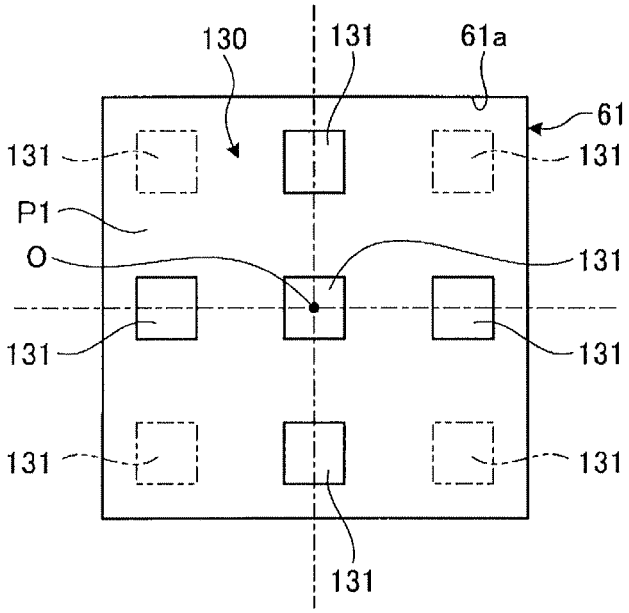
FIG. 10 is a front view illustrating a second modified example of the combustion burner of the second embodiment.
Figure 11:
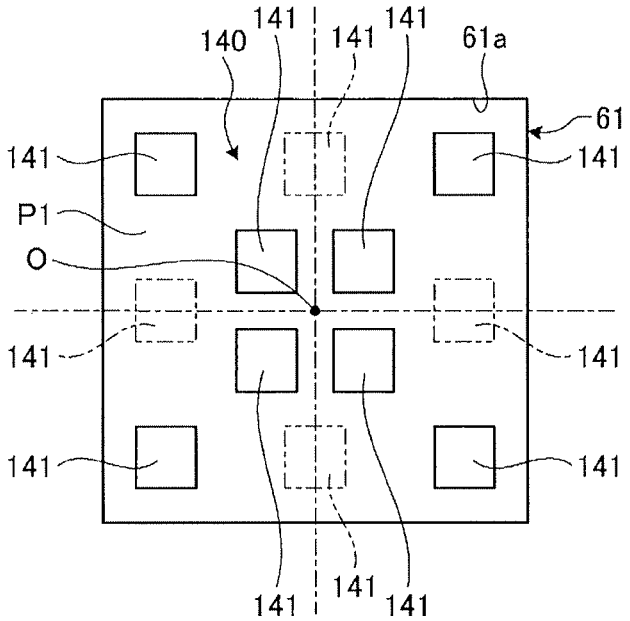
FIG. 11 is a front view illustrating a third modified example of the combustion burner of the second embodiment.

Note that, with the combustion burner 21A, the configuration of the flame stabilizer 110 is not limited to the embodiment described above. FIG. 9 is a front view illustrating a first modified example of the combustion burner of the second embodiment. FIG. 10 is a front view illustrating a second modified example of the combustion burner of the second embodiment. FIG. 11 is a front view illustrating a third modified example of the combustion burner of the second embodiment.

As illustrated in FIG. 9, a flame stabilizer 120 is disposed on the leading end, that is, on the downstream side in the flow direction of the fuel gas, of the fuel nozzle 61. The flame stabilizer 120 functions as a member for igniting the fuel gas of the fuel nozzle 61 and stabilizing the flames thereof. The flame stabilizer 120 is constituted by a plurality (four in the present embodiment) of flame stabilizer main bodies 121, and the plurality of flame stabilizer main bodies 121 are disposed separated a predetermined space from each other and are also disposed separated a predetermined space from the inner wall surface 61*a* of the fuel nozzle 61. Additionally, each of the flame stabilizer main bodies 121 forms a circular pillar shape parallel to the axial line (center line of the fuel nozzle 61) O along the ejection direction of the fuel gas.

The plurality of flame stabilizer main bodies 121 are disposed in a lattice form as the flame stabilizer 120 in the fuel nozzle 61. Note that as illustrated by the long dashed double-short dashed line in FIG. 9, a flame stabilizer main body 121 may also be disposed at a position on the axial line O along the ejection direction of the fuel gas. Moreover, the widened portion is provided at the leading ends of the flame stabilizer main bodies 121, and the widened portion is disposed such that the end surfaces are aligned on the same plane and at the same position in the flow direction of the fuel gas as the opening of the fuel nozzle 61.

The plurality of flame stabilizer main bodies 121 are supported on the inner wall surface 61*a* of the fuel nozzle 61 by a plurality (eight in the present embodiment) of support members 122. Each of the support members 122 connects the inner wall surface 61*a* of the fuel nozzle 61 to a portion of the flat portion of the flame stabilizer main bodies 121. Additionally, the plurality of flame stabilizer main bodies 121 are connected to each other by a plurality (four in the present embodiment) of support members 123.

As illustrated in FIG. 10, a flame stabilizer 130 is disposed on the leading end, that is, on the downstream side in the flow direction of the fuel gas, of the fuel nozzle 61. The flame stabilizer 130 functions as a member for igniting the fuel gas of the fuel nozzle 61 and stabilizing the flames thereof. The flame stabilizer 130 is constituted by a plurality (eight in the present embodiment) of flame stabilizer main bodies 131, and the plurality of flame stabilizer main bodies 131 are disposed separated a predetermined space from each other and are also disposed separated a predetermined space from the inner wall surface 61*a* of the fuel nozzle 61. Additionally, each of the flame stabilizer main bodies 131 forms a quadrangular pillar shape parallel to the axial line (center line of the fuel nozzle 61) O along the ejection direction of the fuel gas.

The plurality of flame stabilizer main bodies 131 are disposed in a cross arrangement as the flame stabilizer 130 in the fuel nozzle 61. Note that, as illustrated by the long dashed double-short dashed lines of FIG. 10, the flame stabilizer main bodies 131 may also be disposed in a lattice form. Moreover, the widened portion is provided at the leading ends of the flame stabilizer main bodies 131, and the widened portion is disposed such that the end surfaces are aligned on the same plane and at the same position in the flow direction of the fuel gas as the opening of the fuel nozzle 61.

As illustrated in FIG. 11, a flame stabilizer 140 is disposed on the leading end, that is, on the downstream side in the flow direction of the fuel gas, of the fuel nozzle 61. The flame stabilizer 140 functions as a member for igniting the fuel gas of the fuel nozzle 61 and stabilizing the flames thereof. The flame stabilizer 140 is constituted by a plurality (eight in the present embodiment) of flame stabilizer main bodies 141, and the plurality of flame stabilizer main bodies 141 are disposed separated a predetermined space from each other and are also disposed separated a predetermined space from the inner wall surface 61*a* of the fuel nozzle 61. Additionally, each of the flame stabilizer main bodies 141 forms a quadrangular pillar shape parallel to the axial line (center line of the fuel nozzle 61) O along the ejection direction of the fuel gas.

The plurality of flame stabilizer main bodies 141 are disposed in a staggered form as the flame stabilizer 140 in the fuel nozzle 61. Note that, as illustrated by the long dashed double-short dashed lines of FIG. 11, the flame stabilizer main bodies 141 may also be disposed in a lattice form. Moreover, the widened portion is provided at the leading ends of the flame stabilizer main bodies 141, and the widened portion is disposed such that the end surfaces are aligned on the same plane and at the same position in the flow direction of the fuel gas as the opening of the fuel nozzle 61.

Thus, the combustion burner of the second embodiment is provided with the fuel nozzle 61 configured to eject fuel gas obtained by mixing pulverized coal and air; the combustion air nozzle 62 configured to eject air from outside the fuel nozzle 61; and the flame stabilizer 110 (120, 130, and 140) including the plurality of flame stabilizer main bodies 111 (121, 131, and 141) disposed on the leading end of the fuel nozzle 61 and separated by the predetermined space from the inner wall surface 61*a* of the fuel nozzle 61, the plurality of flame stabilizer main bodies 111 (121, 131, and 141) forming a ring shape having an axial line along an ejection direction of the fuel gas as a center O.

Accordingly, a recirculation area is formed on the downstream side of the flame stabilizer main bodies 111 and, as a result, the fuel gas flowing in the fuel nozzle 61 can maintain the combustion of the fuel gas (pulverized coal). Here, because the plurality of flame stabilizer main bodies 111 are disposed so as to be separated the predetermined space from each other and are also separated the predetermined space from the inner wall surface 61*a* of the fuel nozzle 61, the flame stabilizers will not cross each other even if the number of the plurality of flame stabilizer main bodies 111 or the size of the plurality of flame stabilizer main bodies 111 is increased. As a result, guide surfaces for forming the recirculation area can be sufficiently secured without causing interference of ignition. Furthermore, fluctuation of the flow rate and the fuel concentration of the fuel gas at the leading end of the fuel nozzle 61 can be suppressed. As a result, interference of ignition between flame stabilizers can be suppressed and flame stabilizing performance can be enhanced.

With the combustion burner of the second embodiment, the plurality of flame stabilizer main bodies 111 (121, 131, and 141) are disposed in a lattice form or a scattered form. Accordingly, interference of ignition does not occur and, also, the periphery of each individual flame stabilizer main body 111 can be configured as an ignition surface. Thus, the plurality of flame stabilizer main bodies 111 can be efficiently disposed in the fuel nozzle 61.

With the combustion burner of the second embodiment, the guide surfaces 111*a* are provided as flat portions at portions where the plurality of flame stabilizer main bodies 111 (131 and 141) face each other. Accordingly, the fuel gas (pulverized matter) is collected in a predetermined region by the guide surfaces 111*a* that face each other, and flame stabilizing performance can be enhanced.

Third Embodiment

Figure 12:
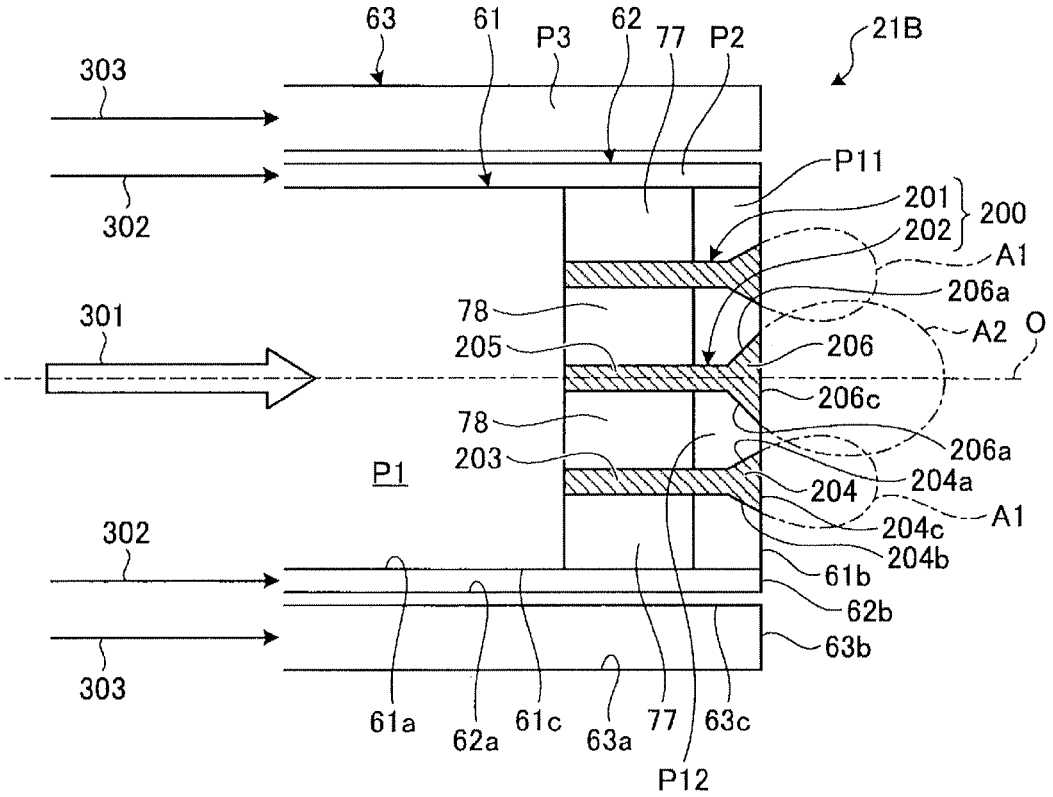
FIG. 12 is a vertical cross-sectional view of a combustion burner of a third embodiment.

FIG. 12 is a vertical cross-sectional view of a combustion burner of a third embodiment. Note that the same reference numerals are given to members having the same functions as the embodiments described above and detailed description thereof will be omitted.

In the third embodiment, as illustrated in FIG. 12, a combustion burner 21B is provided with, from the center side, a fuel nozzle 61, a combustion air nozzle 62, and a secondary air nozzle 63. Additionally, a flame stabilizer 200 is provided in the fuel nozzle 61.

The fuel nozzle 61 is capable of ejecting fuel gas obtained by mixing pulverized coal and primary air. The combustion air nozzle 62 is capable of ejecting fuel gas combustion air on the outer peripheral side of the fuel gas ejected from the fuel nozzle 61. The secondary air nozzle 63 is capable of ejecting secondary air on the outer peripheral side of the fuel gas combustion air ejected from the combustion air nozzle 62. The flame stabilizer 200 is disposed in the fuel nozzle 61, at the leading end, that is, on the downstream side in the flow direction of the fuel gas, of the fuel nozzle 61. As such, the flame stabilizer 200 functions as a member for igniting the fuel gas and stabilizing the flame thereof. The flame stabilizer 200 is constituted by a first flame stabilizer main body 201 and a second flame stabilizer main body 202. The first flame stabilizer main body 201 forms a rectangular ring shape having the axial line O along the ejection direction of the fuel gas as a center. The second flame stabilizer main body 202 forms a quadrangular pillar shape having the axial line O along the ejection direction of the fuel gas as a center. Note that, when viewed from the front, the first flame stabilizer main body 201 and the second flame stabilizer main body 202 form substantially the same shapes as the first flame stabilizer main body 71 and the second flame stabilizer main body 72 of the first embodiment (see FIG. 1).

The first flame stabilizer main body 201 is constituted by a flat portion 203 and a widened portion 204. The cross-section of the widened portion 204 forms a substantially isosceles triangle shape. A base end is connected to the flat portion 203, the width of the leading end increases toward the downstream side in the flow direction of the fuel gas, and the leading edge is a surface that is orthogonal to the flow direction of the fuel gas. Specifically, the widened portion 204 includes a first guide surface 204*a* on an inner side that forms a quadrangular ring shape and is inclined toward the center line O side with respect to the flow direction of the fuel gas, a second guide surface 204*b* on an outer side that forms a quadrangular ring shape and is inclined away from the center line O side with respect to the flow direction of the fuel gas, and an end surface 204*c* on the front end side that forms a quadrangular ring shape.

On the other hand, the second flame stabilizer main body 202 is constituted by a flat portion 205 and a widened portion 206. When viewed from above and from the side (or in a cross section), the widened portion 206 forms a substantially isosceles triangle shape. A base end is connected to the flat portion 205, the width of the leading end increases toward the downstream side in the flow direction of the fuel gas, and the leading edge is a surface that is orthogonal to the flow direction of the fuel gas. Specifically, the widened portion 206 includes guide surfaces 206*a* on outer side that form a quadrangular rod shape and are inclined away from the center line O side with respect to the flow direction of the fuel gas, and an end surface 206*c* on the front end side that forms a quadrangular shape.

With the widened portion 206 of the second flame stabilizer main body 202, the four guide surfaces 206*a* face a portion of the guide surface 204*a* of the widened portion 204 of the first flame stabilizer main body 201. Moreover, the spread angle of the guide surfaces 206*a* of the widened portion 206 of the second flame stabilizer main body 202 is configured to be greater than the spread angle of the guide surfaces 204*a* of the widened portion 204 of the first flame stabilizer main body 201. As such, with the fuel gas ejected from the fuel nozzle 61, a recirculation area A2 formed by the guide surfaces 206*a* of the second flame stabilizer main body 202 is larger than a recirculation area A1 formed by the guide surfaces 204*a* and 204*b* of the first flame stabilizer main body 201, and portions of the recirculation areas A1 and A2 overlap.

In the combustion burner 21B configured as described above, the fuel gas flows through flow path of the fuel nozzle 61 and is ejected from the opening 61*b* into the furnace 11 (see FIG. 2). The fuel gas combustion air flows through the flow path of the combustion air nozzle 62 and is ejected from the opening 62*b* outside of the fuel gas. The secondary air flows through the flow path of the secondary air nozzle 63 and is ejected from the opening 63*b* outside of the fuel gas combustion air. Here, the fuel gas (pulverized coal and primary air), the fuel gas combustion air, and the secondary air are ejected as straight flows along the burner axis direction (the center line O) without swirling. Moreover, the fuel gas is split by the first flame stabilizer main body 201 and the second flame stabilizer main body 202 at the opening 61*b* of the fuel nozzle 61 and flows, and is ignited here and combusts, thus becoming combustion gas. Additionally, the fuel gas combustion air is ejected on the outer periphery of the fuel gas to promote the combustion of the fuel gas. Furthermore, the secondary air is ejected on the outer periphery of the combustion flames to adjust the proportions of the fuel gas combustion air and the secondary air and achieve the optimal combustion.

With the flame stabilizer 200, the widened portions 204 and 206 of the first flame stabilizer main body 201 and the second flame stabilizer main body 202 form split shapes and, as such, the fuel gas flows along the guide surfaces 204*a*, 204*b*, and 206*a* of the widened portions 204 and 206, and flows around to the end surface 204*c* and 206*c* sides so as to form the recirculation areas A1 and A2 in front of the end surfaces 204*c* and 206*c*. In this case, the spread angle of the guide surfaces 206*a* of the widened portion 206 is larger than the spread angle of the first guide surface 204*a* of the widened portion 204 and, as such, the fuel gas (pulverized coal) flowing along the guide surfaces 206*a* flows to the adjacent first guide surface 204*a* side. As a result, the inside recirculation area A2 becomes larger than the outside recirculation area A1, and portions of the recirculation areas A1 and A2 overlap. As such, ignition of the fuel gas and flame stabilization thereof is carried out in the recirculation areas A1 and A2, the flames easily spread to each other, and internal flame stabilization of the combustion flames is realized. As a result, the temperature of the outer periphery of the combustion flames lowers, the temperature of the outer periphery of the combustion flames in high-oxygen atmosphere can be lowered by the secondary air, and the amount of NOx produced in the outer periphery of the combustion flames is reduced.

The first flame stabilizer main body 201 forms a ring shape, the second flame stabilizer main body 202 forms a rod shape, and the fuel nozzle 61, the first flame stabilizer main body 201, and the second flame stabilizer main body 202 are not connected. As such, the fuel gas can form the recirculation areas that have a multiple ring shape by the guide surfaces 204*a* and 204*b* of the first flame stabilizer main body 201 and the guide surfaces 206*a* of the second flame stabilizer main body 202, and areas where the recirculation areas A1 and A2 cannot be formed are reduced. Thus, flame stabilizing performance can be enhanced.

Figure 13:
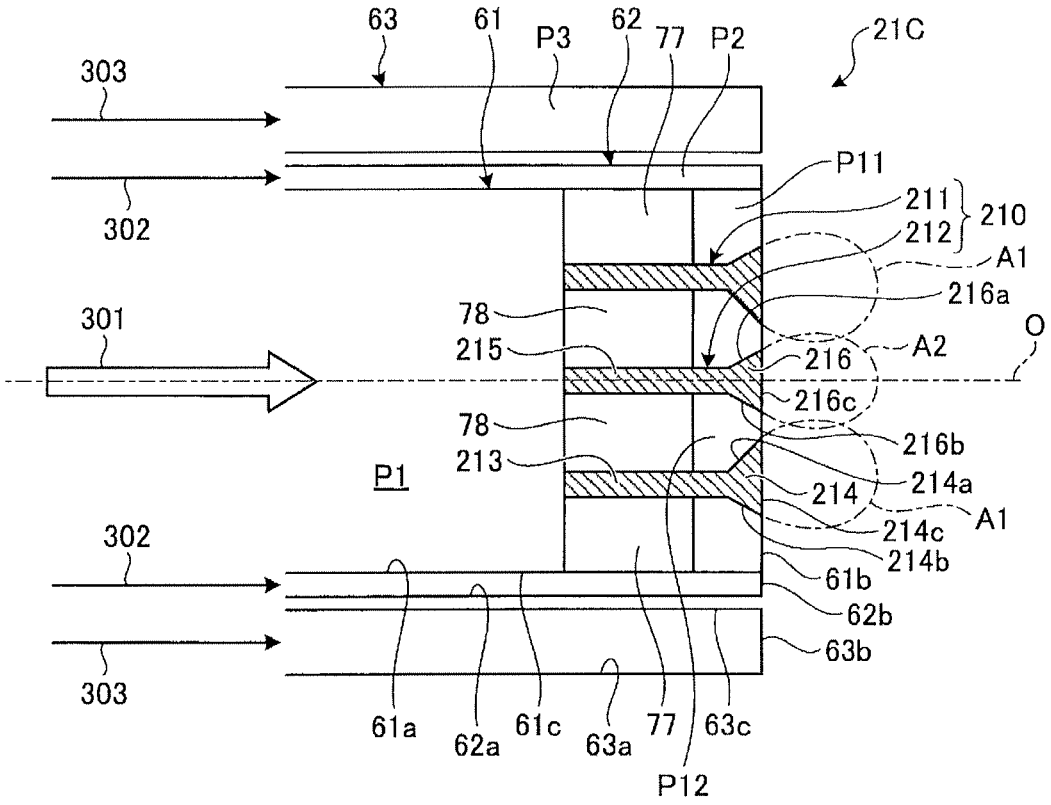
FIG. 13 is a vertical cross-sectional view illustrating a modified example of the combustion burner of the third embodiment.

Note that, with the combustion burner 21B, the configuration of the flame stabilizer 200 is not limited to the embodiment described above. FIG. 13 is a vertical cross-sectional view illustrating a modified example of the combustion burner of the third embodiment.

As illustrated in FIG. 13, a combustion burner 21C is provided with, from the center side, a fuel nozzle 61, a combustion air nozzle 62, and a secondary air nozzle 63. Additionally, a flame stabilizer 210 is provided in the fuel nozzle 61.

The flame stabilizer 210 is disposed in the fuel nozzle 61, at the leading end, that is, on the downstream side in the flow direction of the fuel gas, of the fuel nozzle 61. As such, the flame stabilizer 210 functions as a member for igniting the fuel gas and stabilizing the flame thereof. The flame stabilizer 210 is constituted by a first flame stabilizer main body 211 and a second flame stabilizer main body 212. The first flame stabilizer main body 211 forms a rectangular ring shape having the axial line O along the ejection direction of the fuel gas as a center. The second flame stabilizer main body 212 forms a quadrangular prismatic cylinder shape having the axial line O along the ejection direction of the fuel gas as a center.

The first flame stabilizer main body 211 is constituted by a flat portion 213 and a widened portion 214. The widened portion 214 includes a first guide surface 214*a* on an inner side that forms a quadrangular ring shape and is inclined toward the center line O side with respect to the flow direction of the fuel gas, a second guide surface 214*b* on an outer side that forms a quadrangular ring shape and is inclined away from the center line O side with respect to the flow direction of the fuel gas, and an end surface 214*c* on the front end side that forms a quadrangular ring shape. On the other hand, the second flame stabilizer main body 212 is constituted by a flat portion 215 and a widened portion 216. The widened portion 216 includes guide surfaces 216*a* on the outer side that form a quadrangular rod shape and are inclined away from the center line O side with respect to the flow direction of the fuel gas, and an end surface 216*c* on the front end side that forms a quadrangular shape.

With the widened portion 216 of the second flame stabilizer main body 212, the four guide surfaces 216*a* face a portion of the guide surface 214*a* of the widened portion 214 of the first flame stabilizer main body 211. Moreover, the spread angle of each guide surface 214*a* of the widened portion 214 of the first flame stabilizer main body 211 is configured to be larger than the spread angle of each guide surface 216*a* of the widened portion 216 of the second flame stabilizer main body 212. As such, with the fuel gas ejected from the fuel nozzle 61, a recirculation area A2 formed by the guide surfaces 216*a* of the second flame stabilizer main body 212 is larger than a recirculation area A1 formed by the guide surfaces 214*a* and 214*b* of the first flame stabilizer main body 211, and portions of the recirculation areas A1 and A2 overlap.

As such, the fuel gas flows through the flow path of the fuel nozzle 61, and is ejected from the opening 61*b* into the furnace 11 (see FIG. 2). Here, the fuel gas is split by the first flame stabilizer main body 211 and the second flame stabilizer main body 212 at the opening 61*b* of the fuel nozzle 61 and flows, and is ignited here and combusts, thus becoming combustion gas. With the flame stabilizer 210, the widened portions 214 and 216 of the first flame stabilizer main body 211 and the second flame stabilizer main body 212 form split shapes and, as such, the fuel gas flows along the guide surfaces 214*a*, 214*b*, and 216*a* of the widened portions 214 and 216, and flows around to the end surface 214*c* and 216*c* sides so as to form the recirculation areas A1 and A2 in front of the end surfaces 214*c* and 216*c*. In this case, the spread angle of the guide surface 214*a* of the widened portion 214 is larger than the spread angle of the guide surface 216*a* of the widened portion 216 and, as such, the fuel gas (pulverized coal) flowing along the guide surface 214*a* flows toward the adjacent guide surface 216*a* side. As a result, the outside recirculation area A1 becomes larger than the inside recirculation area A2, and portions of the recirculation areas A1 and A2 overlap. As such, ignition of the fuel gas and flame stabilization thereof is carried out in the recirculation areas A1 and A2, the flames easily spread to each other, and internal flame stabilization of the combustion flames is realized. As a result, the temperature of the outer periphery of the combustion flames lowers, the temperature of the outer periphery of the combustion flames in high-oxygen atmosphere can be lowered by the secondary air, and the amount of NOx produced in the outer periphery of the combustion flames is reduced.

The combustion burner of the third embodiment described above is provided with the flame stabilizer 200 disposed on the leading end of the fuel nozzle 61 and separated by the predetermined space from the inner wall surface 61*a* of the fuel nozzle 61, the flame stabilizer 200 including the first and second flame stabilizer main bodies 201 and 202 that form ring shapes having the axial line along the ejection direction of the fuel gas as a center O. The first and second flame stabilizer main bodies 201 and 202 include the widened portions 204 and 206 that have triangular cross-sectional shapes that widen toward the downstream side in the ejection direction of the fuel gas, and the spread angle of the guide surfaces 206*a* of the widened portion 206 of the second flame stabilizer main body 202 is configured to be larger than the spread angle of the guide surfaces 204*a* of the widened portion 204 of the first flame stabilizer main body 201.

Accordingly, the fuel gas flows along the guide surfaces 204*a*, 204*b*, and 206*a* of the widened portions 204 and 206 and flows around to the end surface 204*c* and 206*c* sides to form the recirculation areas A1 and A2. However, the spread angle of the guide surfaces 206*a* of the widened portion 206 is larger than the spread angle of the guide surfaces 204*a* of the widened portion 204. As a result, the inside recirculation area A2 becomes larger than the outside recirculation area A1 and portions of the recirculation areas A1 and A2 overlap. As such, ignition of the fuel gas and flame stabilization thereof is carried out in the recirculation areas A1 and A2, the flames easily spread to each other across a wide range, and internal flame stabilizing performance of the combustion flames can be enhanced.

The combustion burner of the third embodiment is provided with the flame stabilizer 210 disposed on the leading end of the fuel nozzle 61 and separated by the predetermined space from the inner wall surface 61*a* of the fuel nozzle 61, the flame stabilizer 210 including the first and second flame stabilizer main bodies 211 and 212 that form ring shapes having the axial line along the ejection direction of the fuel gas as a center O. The first and second flame stabilizer main bodies 211 and 212 include the widened portions 214 and 216 that have triangular cross-sectional shapes that widen toward the downstream side in the ejection direction of the fuel gas, and the spread angle of each guide surface 214*a* of the widened portion 214 of the first flame stabilizer main body 211 is configured to be larger than the spread angle of each guide surface 216*a* of the widened portion 216 of the second flame stabilizer main body 212.

Accordingly, the fuel gas flows along the guide surfaces 214*a*, 214*b*, and 216*a* of the widened portions 214 and 216 and flows around to the end surface 214*c* and 216*c* sides to form the recirculation areas A1 and A2. However, the spread angle of each guide surface 214*a* of the widened portion 214 is larger than the spread angle of each guide surface 216*a* of the widened portion 216. As a result, the outside recirculation area A1 becomes larger than the inside recirculation area A2 and portions of the recirculation areas A1 and A2 overlap. As such, ignition of the fuel gas and flame stabilization thereof is carried out in the recirculation areas A1 and A2, the flames easily spread to each other across a wide range, and internal flame stabilizing performance of the combustion flames can be enhanced.

Fourth Embodiment

Figure 14:
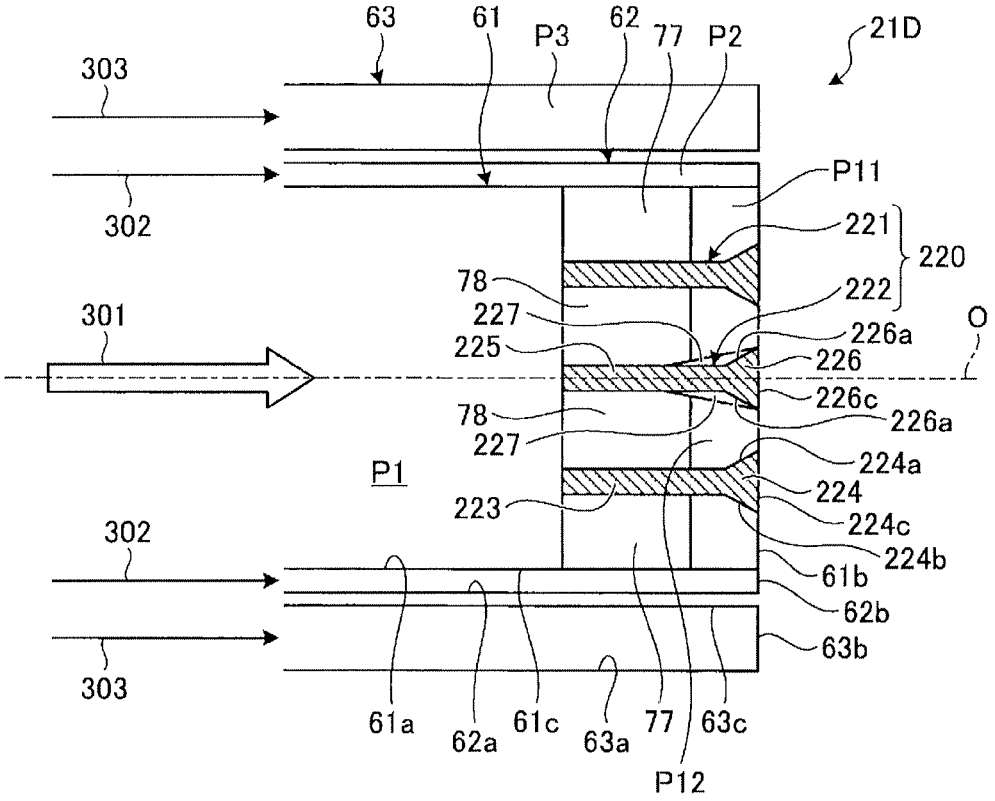
FIG. 14 is a vertical cross-sectional view of a combustion burner of a fourth embodiment.

FIG. 14 is a vertical cross-sectional view of a combustion burner of a fourth embodiment. Note that the same reference numerals are given to members having the same functions as the embodiments described above and detailed description thereof will be omitted.

In the fourth embodiment, as illustrated in FIG. 14, a combustion burner 21D is provided with, from the center side, a fuel nozzle 61, a combustion air nozzle 62, and a secondary air nozzle 63. Additionally, a flame stabilizer 220 is provided in the fuel nozzle 61.

The fuel nozzle 61 is capable of ejecting fuel gas obtained by mixing pulverized coal and primary air. The combustion air nozzle 62 is capable of ejecting fuel gas combustion air on the outer peripheral side of the fuel gas ejected from the fuel nozzle 61. The secondary air nozzle 63 is capable of ejecting secondary air on the outer peripheral side of the fuel gas combustion air ejected from the combustion air nozzle 62. The flame stabilizer 220 is disposed in the fuel nozzle 61, at the leading end, that is, on the downstream side in the flow direction of the fuel gas, of the fuel nozzle 61. As such, the flame stabilizer 220 functions as a member for igniting the fuel gas and stabilizing the flame thereof. The flame stabilizer 220 is constituted by a first flame stabilizer main body 221 and a second flame stabilizer main body 222. The first flame stabilizer main body 221 forms a rectangular ring shape having the axial line O along the ejection direction of the fuel gas as a center. The second flame stabilizer main body 222 forms a quadrangular pillar shape having the axial line O along the ejection direction of the fuel gas as a center. Note that, when viewed from the front, the first flame stabilizer main body 221 and the second flame stabilizer main body 222 form substantially the same shapes as the first flame stabilizer main body 71 and the second flame stabilizer main body 72 of the first embodiment (see FIG. 1).

The first flame stabilizer main body 221 is constituted by a flat portion 223 and a widened portion 224. The widened portion 224 includes a first guide surface 224*a* inclined to the inside, a second guide surface 224*b* inclined to the outside, and an end surface 224*c* on the front end side. On the other hand, the second flame stabilizer main body 222 is constituted by a flat portion 225 and a widened portion 226. The widened portion 226 includes guide surfaces 226*a* inclined to the outside and an end surface 226*c* on the front end side.

A swirl vane 227 is provided on the second flame stabilizer main body 222 disposed on the center side of the fuel nozzle 61. The swirl vane 227 is provided over a portion of the flat portion 225 and the widened portion 226 of the second flame stabilizer main body 222. The swirl vane 227 is a so-called swirl wing, and a plurality of the swirl vane 227 are provided at equal intervals in the circumferential direction on the outer periphery of the second flame stabilizer main body 222. As such, due to the swirl vanes 227 of the second flame stabilizer main body 222, swirling force acts on the fuel gas ejected from the fuel nozzle 61 and the fuel gas spreads outward. Moreover, a recirculation area formed by the guide surfaces 226*a* is larger than a recirculation area formed by the guide surfaces 224*a* and 224*b* of the second flame stabilizer main body 222 (see FIG. 12), and portions of the recirculation areas overlap.

In the combustion burner 21D configured as described above, the fuel gas flows through flow path of the fuel nozzle 61 and is ejected from the opening 61*b* into the furnace 11 (see FIG. 2). The fuel gas combustion air flows through the flow path of the combustion air nozzle 62 and is ejected from the opening 61*b* outside of the fuel gas. The secondary air flows through the flow path of the secondary air nozzle 63 and is ejected from the opening 63*b* outside of the fuel gas combustion air. Here, the fuel gas (pulverized coal and primary air), the fuel gas combustion air, and the secondary air are ejected as straight flows along the burner axis direction (the center line O) without swirling. Moreover, the fuel gas is split by the first flame stabilizer main body 221 and the second flame stabilizer main body 222 at the opening 61*b* of the fuel nozzle 61 and flows, and is ignited here and combusts, thus becoming combustion gas. Additionally, the fuel gas combustion air is ejected on the outer periphery of the fuel gas to promote the combustion of the fuel gas. Furthermore, the secondary air is ejected on the outer periphery of the combustion flames to adjust the proportions of the fuel gas combustion air and the secondary air and achieve the optimal combustion.

With the flame stabilizer 220, the widened portions 224 and 226 of the first flame stabilizer main body 221 and the second flame stabilizer main body 222 form split shapes and, as such, the fuel gas flows along the guide surfaces 224*a*, 224*b*, and 226*a* of the widened portions 224 and 226, and flows around to the end surface 224*c* and 226*c* sides so as to form the recirculation areas in front of the end surfaces 224*c* and 226*c*. In this case, the swirl vanes 227 are provided on the second flame stabilizer main body 222 and, as such, the fuel gas (pulverized coal) flows toward the adjacent guide surfaces 224*a* along the guide surfaces 226*a* while swirling. As a result, the inside recirculation area becomes larger than the outside recirculation area, and portions of the recirculation areas overlap and are strengthened. As such, ignition of the fuel gas and flame stabilization thereof in the recirculation areas is strengthened, the flames easily spread to each other, and internal flame stabilization of the combustion flames is realized. As a result, the temperature of the outer periphery of the combustion flames lowers, the temperature of the outer periphery of the combustion flames in high-oxygen atmosphere can be lowered by the secondary air, and the amount of NOx produced in the outer periphery of the combustion flames is reduced.

The first flame stabilizer main body 221 forms a ring shape, the second flame stabilizer main body 222 forms a rod shape, and the fuel nozzle 61, the first flame stabilizer main body 221, and the second flame stabilizer main body 222 are not connected. As such, the fuel gas can form the recirculation areas that have a multiple ring shape by the guide surfaces 224*a* and 224*b* of the first flame stabilizer main body 221 and the guide surfaces 226*a* of the second flame stabilizer main body 222, and areas where the recirculation areas cannot be formed are reduced. Thus, flame stabilizing performance can be enhanced.

Figure 15:
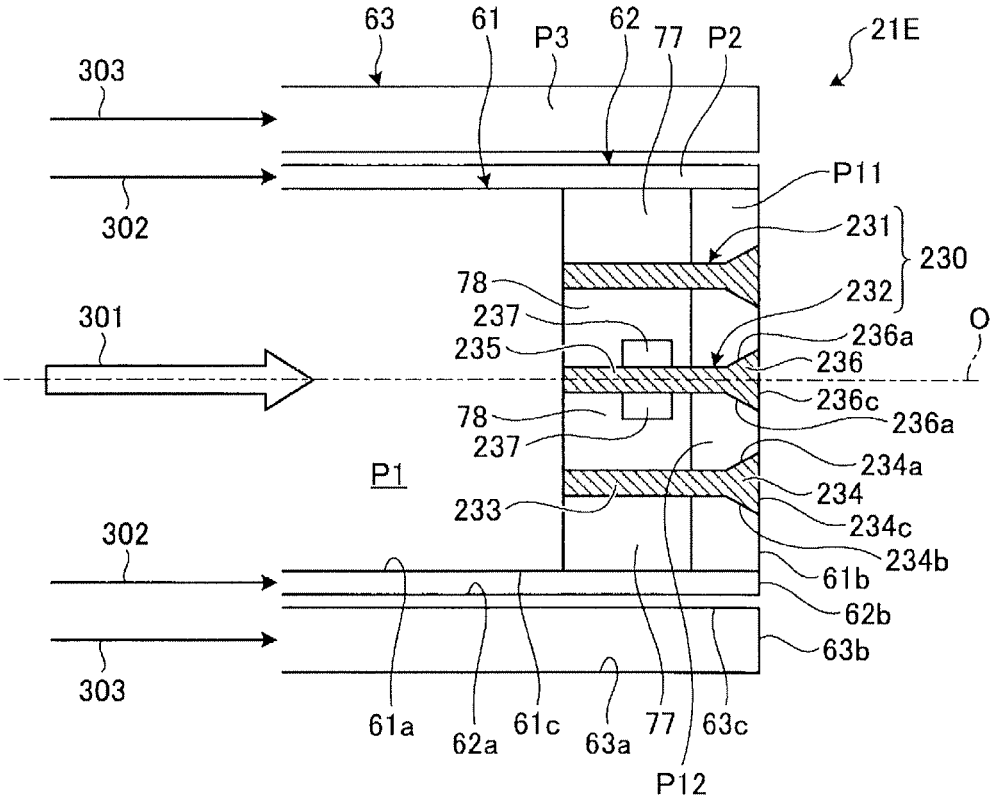
FIG. 15 is a vertical cross-sectional view illustrating a first modified example of the combustion burner of the fourth embodiment.
Figure 16:
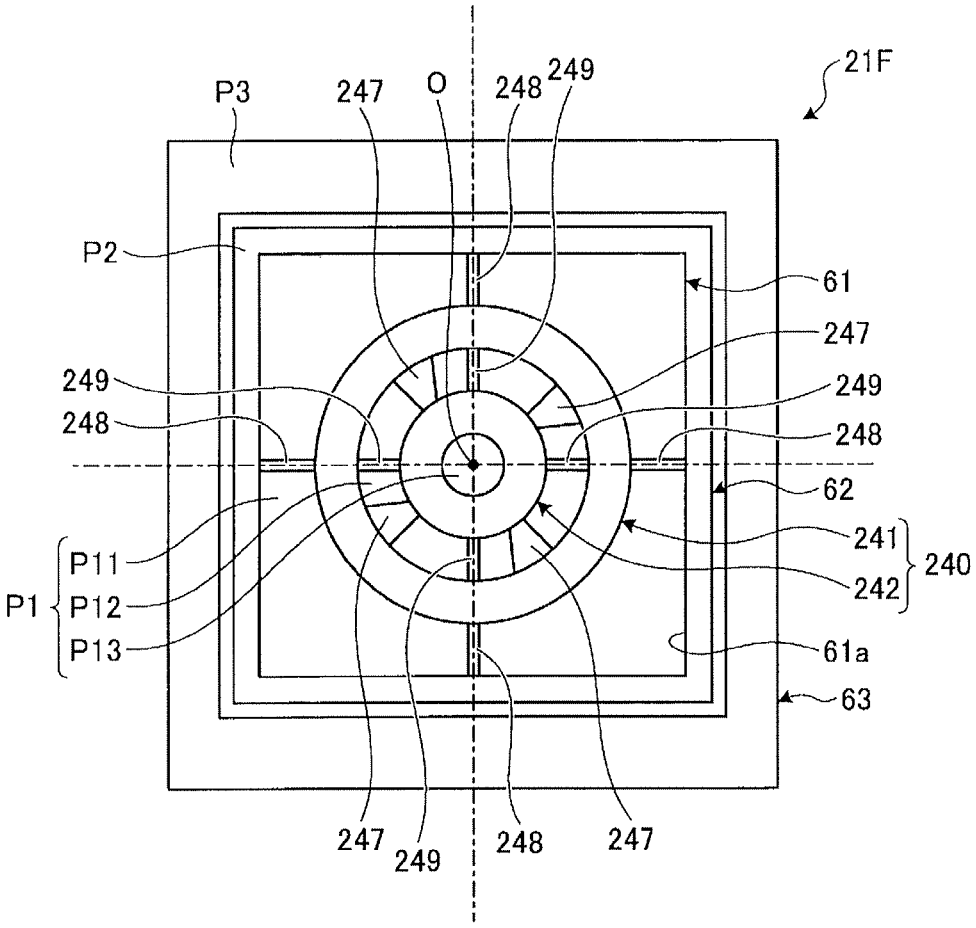
FIG. 16 is a front view illustrating a second modified example of the combustion burner of the fourth embodiment.
Figure 17:
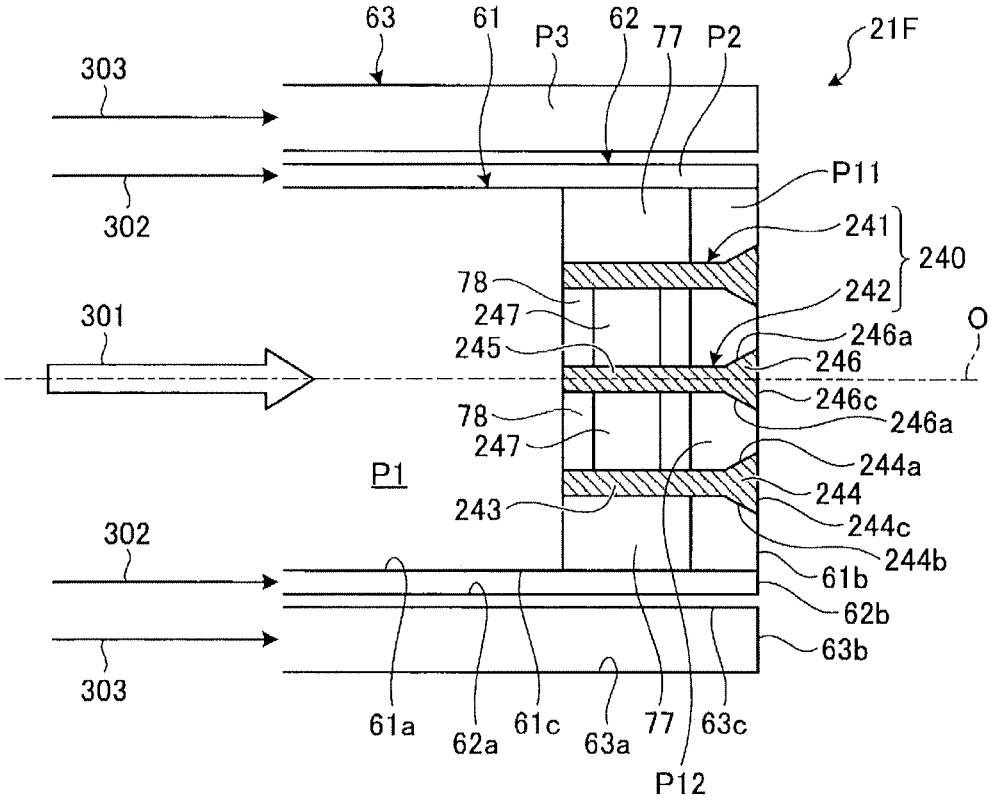
FIG. 17 is a vertical cross-sectional view of the second modified example of the combustion burner.

Note that, with the combustion burner 21D, the configuration of the flame stabilizer 220 is not limited to the embodiment described above. FIG. 15 is a vertical cross-sectional view illustrating a first modified example of the combustion burner of the fourth embodiment. FIG. 16 is a front view illustrating a second modified example of the combustion burner of the fourth embodiment. FIG. 17 is a vertical cross-sectional view of the second modified example of the combustion burner.

As illustrated in FIG. 15, a combustion burner 21E is provided with, from the center side, a fuel nozzle 61, a combustion air nozzle 62, and a secondary air nozzle 63. Additionally, a flame stabilizer 230 is provided in the fuel nozzle 61.

The flame stabilizer 220 is disposed in the fuel nozzle 61, at the leading end, that is, on the downstream side in the flow direction of the fuel gas, of the fuel nozzle 61. As such, the flame stabilizer 220 functions as a member for igniting the fuel gas and stabilizing the flame thereof. The flame stabilizer 230 is constituted by a first flame stabilizer main body 231 and a second flame stabilizer main body 232. The first flame stabilizer main body 231 forms a rectangular ring shape having the axial line O along the ejection direction of the fuel gas as a center. The second flame stabilizer main body 232 forms a quadrangular pillar shape having the axial line O along the ejection direction of the fuel gas as a center.

The first flame stabilizer main body 231 is constituted by a flat portion 233 and a widened portion 234. The widened portion 234 includes a first guide surface 234*a* inclined to the inside, a second guide surface 234*b* inclined to the outside, and an end surface 234*c* on the front end side. On the other hand, the second flame stabilizer main body 232 is constituted by a flat portion 235 and a widened portion 236. The widened portion 236 includes guide surfaces 236*a* inclined to the outside and an end surface 236*c* on the front end side.

A swirl vane 237 is provided on the second flame stabilizer main body 232 disposed on the center side of the fuel nozzle 61. The swirl vane 237 is provided on the flat portion 235 of the second flame stabilizer main body 232. The swirl vane 237 is a so-called swirl wing, and a plurality of the swirl vane 237 are provided at equal intervals in the circumferential direction on the outer periphery of the second flame stabilizer main body 232. As such, due to the swirl vanes 237 of the second flame stabilizer main body 232, swirling force acts on the fuel gas ejected from the fuel nozzle 61 and the fuel gas spreads outward. Moreover, a recirculation area formed by the guide surfaces 236*a* is larger than a recirculation area formed by the guide surface 234*a* of the first flame stabilizer main body 231, and portions of the recirculation areas overlap.

As such, the fuel gas flows through the flow path of the fuel nozzle 61, and is ejected from the opening 61*b* into the furnace 11 (see FIG. 2). Here, the fuel gas is split by the first flame stabilizer main body 231 and the second flame stabilizer main body 232 at the opening 61*b* of the fuel nozzle 61 and flows, and is ignited here and combusts, thus becoming combustion gas. With the flame stabilizer 230, the widened portions 234 and 236 of the first flame stabilizer main body 231 and the second flame stabilizer main body 232 form split shapes and, as such, the fuel gas flows along the guide surfaces 234*a*, 234*b*, and 236*a* of the widened portions 234 and 236, and flows around to the end surface 234*c* and 236*c* sides so as to form the recirculation areas in front of the end surfaces 234*c* and 236*c*. In this case, the swirl vanes 237 are provided on the second flame stabilizer main body 232 and, as such, the fuel gas (pulverized coal) flows toward the adjacent guide surfaces 234*a* along the guide surfaces 236*a* while swirling. As a result, the inside recirculation area becomes larger than the outside recirculation area, and portions of the recirculation areas overlap. As such, ignition of the fuel gas and flame stabilization thereof is carried out in the recirculation areas, the flames easily spread to each other, and internal flame stabilization of the combustion flames is realized. As a result, the temperature of the outer periphery of the combustion flames lowers, the temperature of the outer periphery of the combustion flames in high-oxygen atmosphere can be lowered by the secondary air, and the amount of NOx produced in the outer periphery of the combustion flames is reduced.

As illustrated in FIGS. 16 and 17, a combustion burner 21F is provided with, from the center side, a fuel nozzle 61, a combustion air nozzle 62, and a secondary air nozzle 63. Additionally, a flame stabilizer 240 is provided in the fuel nozzle 61.

The flame stabilizer 240 is disposed in the fuel nozzle 61, at the leading end, that is, on the downstream side in the flow direction of the fuel gas, of the fuel nozzle 61. As such, the flame stabilizer 240 functions as a member for igniting the fuel gas and stabilizing the flame thereof. The flame stabilizer 240 is constituted by a first flame stabilizer main body 241 and a second flame stabilizer main body 242. The first flame stabilizer main body 241 forms a rectangular ring shape having the axial line O along the ejection direction of the fuel gas as a center. The second flame stabilizer main body 242 forms a quadrangular pillar shape having the axial line O along the ejection direction of the fuel gas as a center.

The first flame stabilizer main body 241 is constituted by a flat portion 243 and a widened portion 244. The widened portion 244 includes a first guide surface 244*a* inclined to the inside, a second guide surface 244*b* inclined to the outside, and an end surface 244*c* on the front end side. On the other hand, the second flame stabilizer main body 242 is constituted by a flat portion 245 and a widened portion 246. The widened portion 246 includes guide surfaces 246*a* inclined to the outside and an end surface 246*c* on the front end side.

A swirl vane 247 is provided on the second flame stabilizer main body 242 disposed on the center side of the fuel nozzle 61. The swirl vane 247 is provided spanning the space between the first flame stabilizer main body 241 and the second flame stabilizer main body 242. The swirl vane 247 is a so-called swirl wing, and is disposed so as to span between the flat portion 243 of the first flame stabilizer main body 241 and the flat portion 245 of the second flame stabilizer main body 242. A plurality of the swirl vanes 247 are provided at even intervals in the circumferential direction on the outer periphery of the second flame stabilizer main body 242. As such, due to the swirl vanes 247 of the second flame stabilizer main body 242, swirling force acts on the fuel gas ejected from the fuel nozzle 61 and the fuel gas spreads outward. Moreover, a recirculation area formed by the guide surfaces 246*a* is larger than a recirculation area formed by the guide surface 244*a* of the first flame stabilizer main body 241, and portions of the recirculation areas overlap.

Note that the outer periphery of the first flame stabilizer main body 241 is supported on the inner wall surface 61*a* of the fuel nozzle 61 by a plurality (four in the present embodiment) of support members 248. Additionally, the outer periphery of the second flame stabilizer main body 242 is supported on the first flame stabilizer main body 241 by a plurality (four in the present embodiment) of support members 249.

As such, the fuel gas flows through the flow path of the fuel nozzle 61, and is ejected from the opening 61*b* into the furnace 11 (see FIG. 2). Here, the fuel gas is split by the first flame stabilizer main body 241 and the second flame stabilizer main body 242 at the opening 61*b* of the fuel nozzle 61 and flows, and is ignited here and combusts, thus becoming combustion gas. With the flame stabilizer 240, the widened portions 244 and 246 of the first flame stabilizer main body 241 and the second flame stabilizer main body 242 form split shapes and, as such, the fuel gas flows along the guide surfaces 244*a*, 244*b*, and 246*a* of the widened portions 244 and 246, and flows around to the end surface 244*c* and 246*c* sides so as to form the recirculation areas in front of the end surfaces 244*c* and 246*c*. In this case, the swirl vanes 247 are provided on the first flame stabilizer main body 241 and, as such, the fuel gas (pulverized coal) flows toward the adjacent first guide surfaces 244*a* along the guide surfaces 246*a* while swirling. As a result, the inside recirculation area becomes larger than the outside recirculation area, and portions of the recirculation areas overlap. As such, ignition of the fuel gas and flame stabilization thereof is carried out in the recirculation areas, the flames easily spread to each other, and internal flame stabilization of the combustion flames is realized. As a result, the temperature of the outer periphery of the combustion flames lowers, the temperature of the outer periphery of the combustion flames in high-oxygen atmosphere can be lowered by the secondary air, and the amount of NOx produced in the outer periphery of the combustion flames is reduced.

Thus, the combustion burner of the fourth embodiment is provided with the flame stabilizer 220 (230 and 240) including the first and second flame stabilizer main bodies 221 and 222 (231 and 232, and 241 and 242) disposed on the leading end of the fuel nozzle 61 and separated by the predetermined space from the inner wall surface 61*a* of the fuel nozzle 61, the first and second flame stabilizer main bodies 221 and 222 (231 and 232, and 241 and 242) forming ring shapes having an axial line along the ejection direction of the fuel gas as a center O. Additionally, the swirl vanes 227 (237 and 247) are disposed on the first flame stabilizer main body 221 (231 and 241).

Accordingly, the fuel gas flows toward the adjacent guide surface 224*a* side along the guide surfaces 226*a* while swirling due to the swirl vanes 227, and flows around to the end surface 224*c* side so as to form recirculation areas. Moreover, because the fuel gas is swirling, the inside recirculation area becomes larger than the outside recirculation area, and portions of the recirculation areas overlap. As such, ignition of the fuel gas and flame stabilization thereof is carried out in the recirculation areas, the flames easily spread to each other across a wide range, and internal flame stabilizing performance of the combustion flames can be enhanced.

Note that, in the third and fourth embodiments described above, modes were described which were applied to the combustion burner of the first embodiment, but the configuration is not limited thereto. The third and fourth embodiments may be applied to all of the embodiments.

In the embodiments described above, the flame stabilizer main bodies were constituted by flat portions and widened portions, but the flame stabilizer main bodies are not limited to this configuration and may, for example, be constituted solely by widened portions. Additionally, guide surfaces were formed on the flame stabilizer main bodies, but the guide surfaces need not be provided. That is, both sides of the widened portions of the flame stabilizer main bodies may be configured as surfaces that are parallel along the ejection direction of the fuel gas.

In the embodiments described above, the fuel nozzles, the combustion air nozzles, and the secondary air nozzles have rectangular shapes, but the shapes of these nozzles are not limited and may, for example, be round.

In the embodiments described above, the boiler of the present invention is a coal burning boiler, but configurations are possible in which the boiler uses biomass, petroleum coke, petroleum residues, or the like as a solid fuel. Additionally, the boiler is not limited to boilers that use solid fuel, and oil burning boilers that use heavy oil or the like may also be used. Furthermore, mixed fuel burning boilers that use these fuels can be also be used.

REFERENCE SIGNS LIST

10 Coal burning boiler
11 Furnace
12 Combustion device
13 Flue
21, 21A, 21B, 21C, 21D, 21E, 21F, 22, 23, 24, 25 Combustion burner
26, 27, 28, 29, 30 Pulverized coal supply pipe
31, 32, 33, 34, 35 Pulverizer
36 Wind box
37 Air duct
39 Additional air nozzle
40 Branch air duct
51, 52, 53 Superheater
54, 55 Reheater
56, 57 Economizer
61 Fuel nozzle
61*a* Inner wall surface
61*b*, 62*b*, 63*b* Opening
62 Combustion air nozzle
63 Secondary air nozzle
64, 80, 90, 100, 110, 120, 130, 140, 200, 210, 220, 230, 240 Flame stabilizer
71, 81, 91, 101, 201, 211, 221, 231, 241 First flame stabilizer main body
72, 82, 92, 102, 202, 212, 222, 232, 242 Second flame stabilizer main body
73, 75, 203, 205, 213, 215, 223, 225, 233, 235, 243, 245 Flat portion
74, 76, 204, 206, 214, 216, 224, 226, 234, 236, 244, 246 Widened portion
74*a*, 204*a*, 214*a*, 224*a*, 234*a*, 244*a* First guide surface
74*b*, 204*b*, 214*b*, 224*b*, 234*b*, 244*b* Second guide surface
74*c*, 76*c*, 204*c*, 206*c*, 214*c*, 216*c*, 224*c*, 226*c*, 234*c*, 236*c*, 244*c*, 246*c* End surface
76*a*, 206*a*, 216*a*, 226*a*, 226*a*, 236*a*, 246*a* Guide surface
77, 78, 83, 84, 93, 94, 103, 104, 112, 113, 122, 123 Support member
111, 121, 131, 141 Flame stabilizer main body
P1 Fuel gas flow path
P11 First fuel gas flow path
P12 Second fuel gas flow path
P2 Combustion air flow path
P3 Secondary air flow path

The invention claimed is:

1. A combustion burner comprising:

a fuel nozzle configured to eject fuel gas obtained by mixing fuel and air;

a secondary air nozzle configured to eject air from outside the fuel nozzle;

a flame stabilizer including a plurality of flame stabilizer main bodies disposed on a leading end of the fuel nozzle, the plurality of flame stabilizer main bodies being separated from each other by a predetermined space, and separated from an inner wall surface of the fuel nozzle by a predetermined space; and a plurality of support members connecting the plurality of flame stabilizer main bodies to the inner wall surface of the fuel nozzle, wherein the plurality of flame stabilizer main bodies each have:

a flat portion having a constant width along a flow direction of the fuel gas; and a widened portion provided integrally at a downstream end of the flat portion in the flow direction of the fuel gas, the widened portion having a width increasing in the flow direction of the fuel gas, and the plurality of support members each have a width that is less than respective widths of each flat portion of the plurality of flame stabilizer main bodies.

2. The combustion burner according to claim 1, wherein:

the plurality of flame stabilizer main bodies are disposed in a lattice form or a staggered form on a surface that is orthogonal to a flow direction of the fuel gas.

3. The combustion burner according to claim 1, wherein:

portions of the plurality of flame stabilizer main bodies that face each other are provided with a flat surface portion.

4. The combustion burner according to claim 1, wherein:

the widened portion forms a triangular cross-sectional shape that widens facing downstream in an ejection direction of the fuel gas;

a plurality of the flame stabilizer main bodies are disposed separated from each other by a predetermined space; and a spread angle of one of the portions of the plurality of flame stabilizer main bodies that face each other is set to be larger than the other of the portions.

5. The combustion burner according to claim 4, wherein:

among the widened portions of plurality of flame stabilizer main bodies, a spread angle of the widened portion disposed on a side of a center of the fuel nozzle is set to be larger than a spread angle of the widened portions disposed on a side of the inner wall surface of the fuel nozzle.

6. The combustion burner according to claim 1, wherein:

the plurality of flame stabilizer main bodies form a ring shape having an axial line along the ejection direction of the fuel gas as a center.

7. The combustion burner according to claim 1, wherein:

a plurality of the flame stabilizer main bodies form a rectangular ring shape or a round ring shape.

8. The combustion burner according to claim 1, wherein:

the widened portion forms a triangular cross-sectional shape that widens facing downstream in the ejection direction of the fuel gas;

a plurality of the flame stabilizer main bodies are disposed separated from each other by a predetermined space; and a swirl vane is disposed on the flame stabilizer main body disposed on the side of the center of the fuel nozzle.

9. A boiler comprising:

a furnace which forms a hollow shape and is installed vertically; and a combustion burner described in claim 1, disposed on the furnace.

* * * * *